US008699201B2

(12) United States Patent
Kohri et al.

(10) Patent No.: US 8,699,201 B2
(45) Date of Patent: Apr. 15, 2014

(54) RELAY FAILURE DETECTING DEVICE, POWER-SUPPLY DEVICE, IMAGE FORMING APPARATUS, RELAY FAILURE DETECTING METHOD, AND COMPUTER PROGRAM PRODUCT

(75) Inventors: Yuusuke Kohri, Kanagawa (JP); Takeshi Sano, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 322 days.

(21) Appl. No.: 13/043,667

(22) Filed: Mar. 9, 2011

(65) Prior Publication Data

US 2011/0228438 A1 Sep. 22, 2011

(30) Foreign Application Priority Data

Mar. 18, 2010 (JP) ..... 2010-063238
Jan. 20, 2011 (JP) ..... 2011-010193

(51) Int. Cl.
*H01H 47/22* (2006.01)

(52) U.S. Cl.
USPC ..... 361/187

(58) Field of Classification Search
USPC ..... 361/187
See application file for complete search history.

(56) References Cited

U.S. PATENT DOCUMENTS

| | | | | | |
|---|---|---|---|---|---|
| 4,418,374 | A * | 11/1983 | Callan | 361/167 |
| 5,153,522 | A * | 10/1992 | Sano | 324/546 |
| 5,703,750 | A * | 12/1997 | Kim et al. | 361/187 |
| 5,914,850 | A * | 6/1999 | Johansson | 361/187 |
| 6,643,112 | B1 * | 11/2003 | Carton et al. | 361/152 |
| 7,659,726 | B2 | 2/2010 | Satoh et al. | |
| 7,853,164 | B2 | 12/2010 | Sanada et al. | |
| 8,542,006 | B2 * | 9/2013 | Liu | 324/207.16 |
| 2009/0074442 | A1 | 3/2009 | Sano et al. | |
| 2010/0238466 | A1 | 9/2010 | Sano | |

FOREIGN PATENT DOCUMENTS

JP 2002-214965 7/2002

* cited by examiner

*Primary Examiner* — Rexford Barnie
*Assistant Examiner* — Tien Mai
(74) *Attorney, Agent, or Firm* — Oblon, Spivak, McClelland, Maier & Neustadt, L.L.P.

(57) ABSTRACT

A relay failure detecting device includes: an opening-closing unit that is driven by a coil for opening and closing a current pathway; a detecting unit that detects a current value of a current flowing in the coil; an opening-closing instructing unit that outputs an instruction signal to instruct opening and closing of the opening-closing unit; and a failure detecting unit that detects a failure in the opening-closing unit by using the current value output by the detecting unit within a predetermined period of time starting from when the instruction signal is output.

9 Claims, 19 Drawing Sheets

FIG. 6

CANNOT SHUTDOWN NORMALLY
AS SECURITY, EARTH LEAKAGE CIRCUIT
BREAKER WILL BE ACTIVATED

FIG. 7

MALFUNCTIONING IS DETECTED
REMOVE CORD AFTER SHUTDOWN
OPERATION IS COMPLETE

RELAY FAILURE DETECTING DEVICE, POWER-SUPPLY DEVICE, IMAGE FORMING APPARATUS, RELAY FAILURE DETECTING METHOD, AND COMPUTER PROGRAM PRODUCT

CROSS-REFERENCE TO RELATED APPLICATIONS

The present application claims priority to and incorporates by reference the entire contents of Japanese Patent Application No. 2010-063238 filed in Japan on Mar. 18, 2010 and Japanese Patent Application No. 2011-010193 filed in Japan on Jan. 20, 2011.

BACKGROUND OF THE INVENTION

1. Field of the Invention

The present invention relates to a relay failure detecting device, a power-supply device, an image forming apparatus, a relay failure detecting method, and a computer program product.

2. Description of the Related Art

Typically, a cutout relay is used for the purpose of interrupting the current of an alternating-current (AC) power or a direct-current (DC) power. As a known technology to detect a failure in the cutout relay, an input detecting circuit from a power supply is connected at a subsequent stage of the cutout relay so as to detect a failure in the cutout relay (e.g., a failure in which the relay does not close or a failure in which the relay does not open) depending on whether a detection signal (e.g., a zero cross signal) is output from the input detecting circuit (e.g., see Japanese Patent Application Laid-open No. 2002-214965).

However, in the conventional technology, a detecting circuit needs to be formed at the side of the contact of the relay. That causes consumption of the electrical power of components (such as photo couplers).

SUMMARY OF THE INVENTION

It is an object of the present invention to at least partially solve the problems in the conventional technology.

According to an aspect of the present invention, there is provided a relay failure detecting device including: an opening-closing unit that is driven by a coil for opening and closing a current pathway; a detecting unit that detects a current value of a current flowing in the coil; an opening-closing instructing unit that outputs an instruction signal to instruct opening and closing of the opening-closing unit; and a failure detecting unit that detects a failure in the opening-closing unit by using the current value output by the detecting unit within a predetermined period of time starting from when the instruction signal is output.

According to another aspect of the present invention, there is provided a relay failure detecting method including: outputting, by a control unit, an instruction signal to instruct opening and closing of an opening-closing unit; controlling, by the opening-closing unit, opening and closing a current pathway when a coil is driven; detecting, by a detecting unit, a current value of a current flowing in the coil; and detecting, by the control unit, a failure in the opening-closing unit by using the current value output by the detecting unit within a predetermined period of time starting from when the instruction signal is output.

According to still another aspect of the present invention, there is provided a non-transitory computer program product including a computer-medium containing instructions that, when executed by a computer, cause the computer to perform a relay failure detecting method for a relay failure detecting device, the relay failure detecting device including: an opening-closing unit that is driven by a coil for opening and closing a current pathway; a detecting unit that detects a current value of a current flowing in the coil; and an opening-closing instructing unit that outputs an instruction signal to instruct opening and closing of the opening-closing unit, the relay failure detecting method including: obtaining the current value, which is detected by the detecting unit, at predetermined intervals within a predetermined period of time starting from when the instruction signal is output; and detecting a failure in the opening-closing unit by monitoring a change in a differential value calculated by differentiating each obtained current value.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 6 is an illustrative diagram of an exemplary failure warning notification screen;

FIG. 7 is an illustrative diagram of another exemplary failure warning notification screen;

DETAILED DESCRIPTION OF THE PREFERRED EMBODIMENTS

Exemplary embodiments of a relay failure detecting device, a power-supply device, an image forming apparatus, a relay failure detecting method, and a computer program product according to the present invention are described in detail below with reference to the accompanying drawings. The present invention is not limited to these exemplary embodiments. Herein, the image forming apparatus can be a scanner, a printer, a facsimileing device, a copying machine, or a multifunction product.

First Embodiment

In a first embodiment according to the present invention, the explanation is given for a case of detecting a failure in a shutdown relay. Herein, a "shutdown relay" points to a relay that is mounted in parallel with an AC switch for the purpose of enhancing the security and protecting a hard disk drive (HDD). Even if the AC switch is abruptly turned OFF during the process of writing data in the HDD, the shutdown relay supplies power through a pathway on the side thereof and, only after the process of writing is complete, stops supplying power. Hence, the HDD is protected. Meanwhile, herein, a relay for which an occurrence of a failure needs to be detected is not limited to a shutdown relay.

During normal functioning of a relay, opening and closing of the relay contact causes a change in the inductance of an internal coil of the relay. However, when a failure occurs, the relay contact does not open or close. Hence, no change occurs in the inductance of the internal coil of the relay. With regard to that issue, in an image forming apparatus according to the first embodiment, a change in the current value of the current flowing in the internal coil of the relay is monitored for the purpose of detecting a change in the inductance of the internal coil of the relay and, by extension, for the purpose of detecting a failure in the relay.

Figure 1:
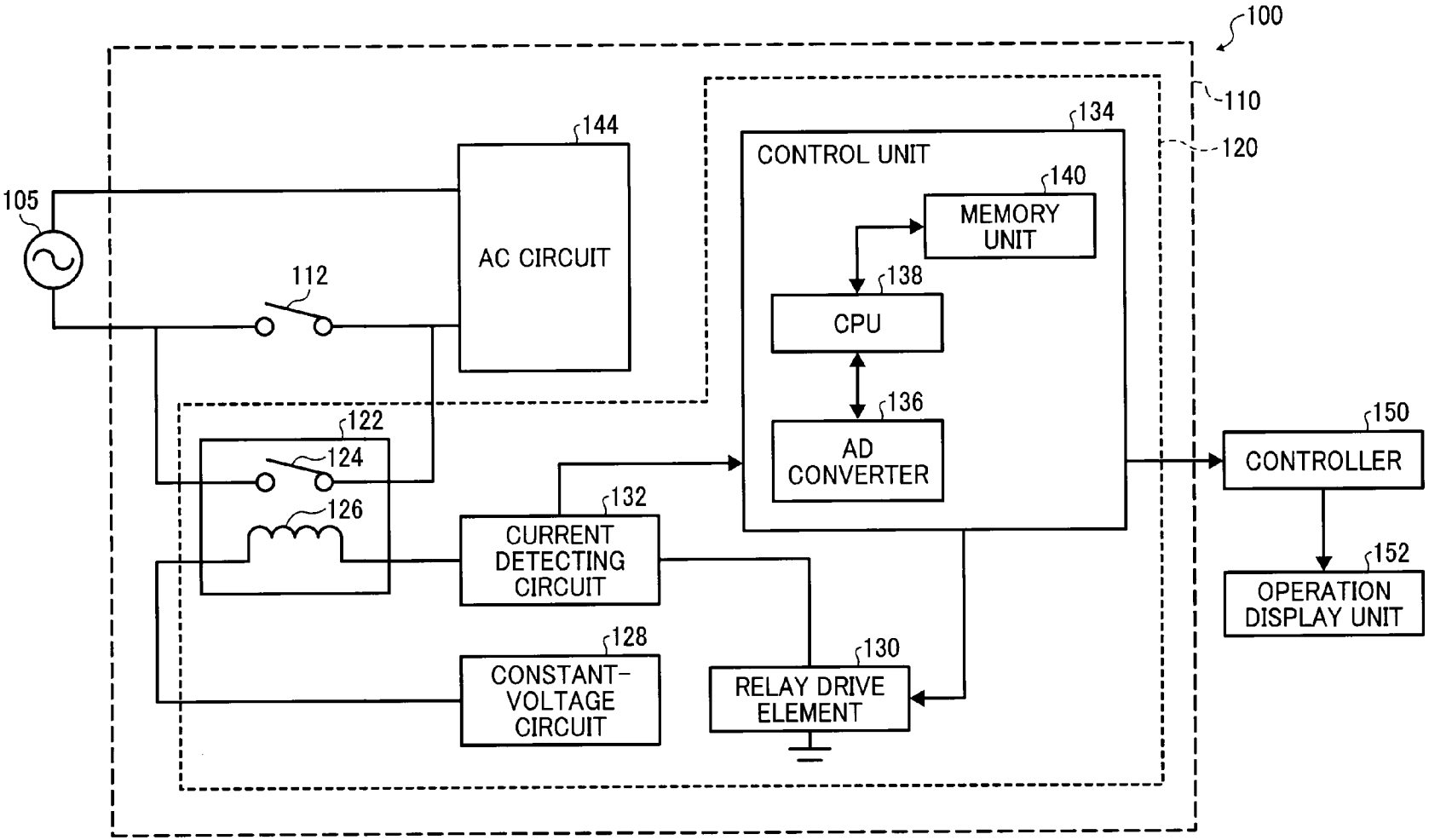
FIG. 1 is a block diagram of an exemplary configuration of an image forming apparatus according to a first embodiment of the present invention.

FIG. 1 is a block diagram of an exemplary configuration of an image forming apparatus 100 according to the first embodiment. As illustrated in FIG. 1, the image forming apparatus 100 includes a power-supply device 110, a controller 150, and an operation display unit 152. The power-supply device 110 includes an AC switch 112, an AC circuit 114, and a relay failure detecting device 120. Moreover, the relay failure detecting device 120 includes a shutdown relay 122, a constant-voltage circuit 128, a relay drive element 130, a current detecting circuit 132, and a control unit 134.

The AC switch 112 (an example of a main switch) is used for switching ON or switching OFF the supply of current from an AC power 105 to the AC circuit 114. Herein, the AC switch 112 can be a mechanical switch or a semiconductor switch. When the AC switch 112 is switched ON so as to allow the current to flow, the AC circuit 114 makes use of a converter (not illustrated) and supplies power to the constant-voltage circuit 128, the control unit 134, and the controller 150.

The shutdown relay 122 is mounted in parallel with the AC switch 112 and performs the shutdown function for protecting the HDD as described above. The shutdown relay 122 includes a contact 124 (an example of an opening-closing unit) for opening and closing the current pathway and includes a coil 126 for driving the contact 124 with the aim of switching the shutdown relay 122 between ON and OFF states.

The constant-voltage circuit 128 maintains the voltage of the coil 126 to a constant level. The relay drive element 130 switches the shutdown relay 122 between ON and OFF states. Once the relay drive element 130 switches ON the shutdown relay 122, the current detecting circuit 132 (an example of a detecting unit) detects the current flowing in the coil 126.

Figure 2:
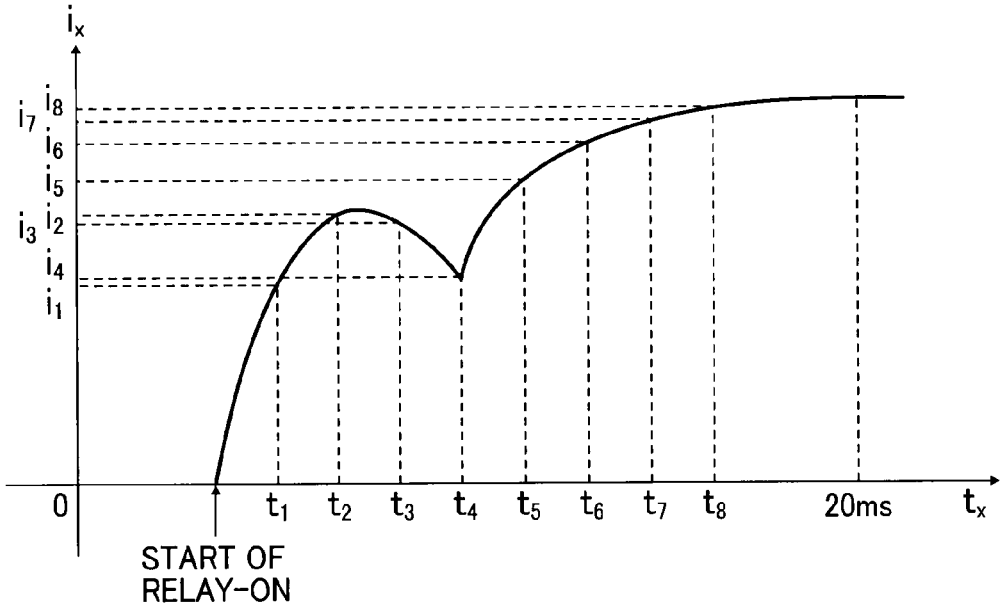
FIG. 2 is a graph representing an exemplary current waveform when a shutdown relay according to the first embodiment is functioning normally.
Figure 3:
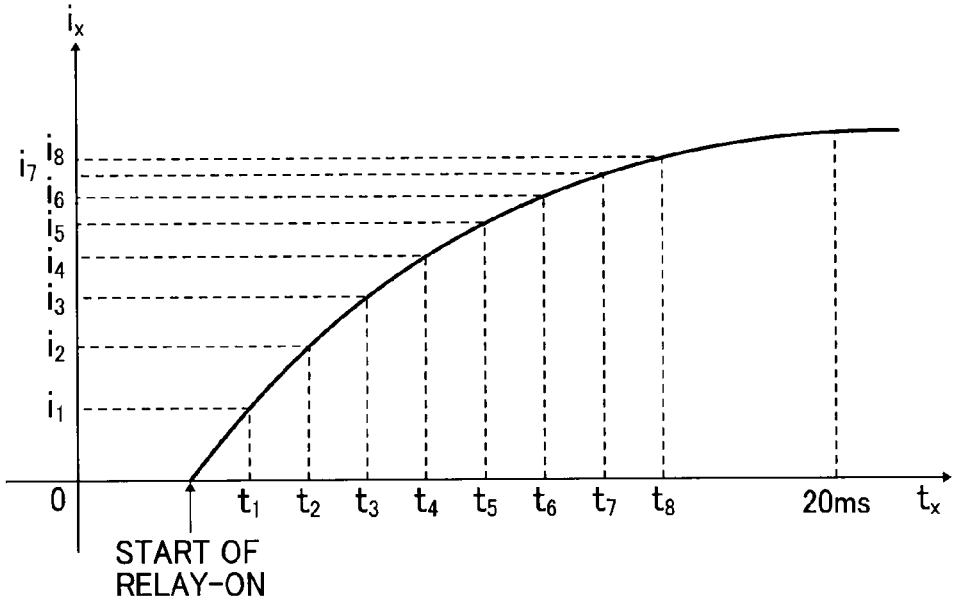
FIG. 3 is a graph representing an exemplary current waveform when a failure occurs in the shutdown relay according to the first embodiment.

Examples of the current waveforms detected by the current detecting circuit 132 are illustrated in FIGS. 2 and 3. The current waveform illustrated in FIG. 2 represents the current values flowing in the coil 126 when the shutdown relay 122 is functioning normally. In contrast, the current waveform illustrated in FIG. 3 represents the current values flowing in the coil 126 when a failure occurs in the shutdown relay 122. As illustrated in FIG. 3, the current values increase uniformly with time.

The control unit 134 includes an analog-to-digital (AD) converter 136 that performs analog-to-digital conversion of the current values detected by the current detecting circuit 132, includes a central processing unit (CPU) 138 that performs signal output and computing, and includes a memory unit 140 for storing the differential values calculated by the CPU 138. The CPU 138 includes an opening-closing instructing unit that outputs a signal for driving the relay drive element 130 and a failure detecting unit that differentiates the current values, which have been subjected to analog-to-digital conversion by the AD converter 136, and calculates the differential values. The memory unit 140 can be a memory device such as a random access memory (RAM).

Figure 4:
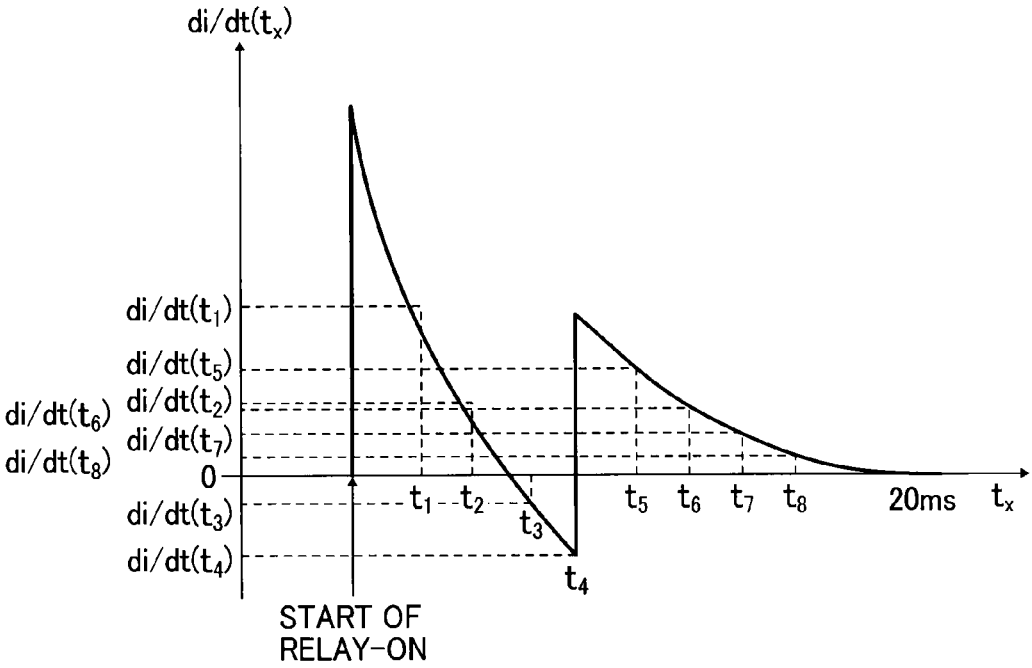
FIG. 4 is a graph representing a differentiated waveform corresponding to the current waveform illustrated in FIG. 2.

In FIG. 4 is illustrated a differentiated waveform corresponding to the current waveform illustrated in FIG. 2. As illustrated in FIG. 4, when the shutdown relay 122 is functioning normally, the differential values do not increase or decrease uniformly with time. When the shutdown relay 122 is functioning normally, the contact 124 physically opens and closes thereby causing variation in the magnetic flux. As a result, the inductance of the coil 126 undergoes changes. Such changes in the inductance of the coil 126 are responsible for the fact that the decrease in the differential values (increase in the current values) is not uniform. Hence, when it is detected that the differential values do not decrease uniformly with time, the CPU 138 determines that the inductance of the coil 126 has changed and thus detects that the relay is functioning normally. Meanwhile, after the contact 124 has closed, the current values generally become constant in about 20 milliseconds (ms).

Figure 5:
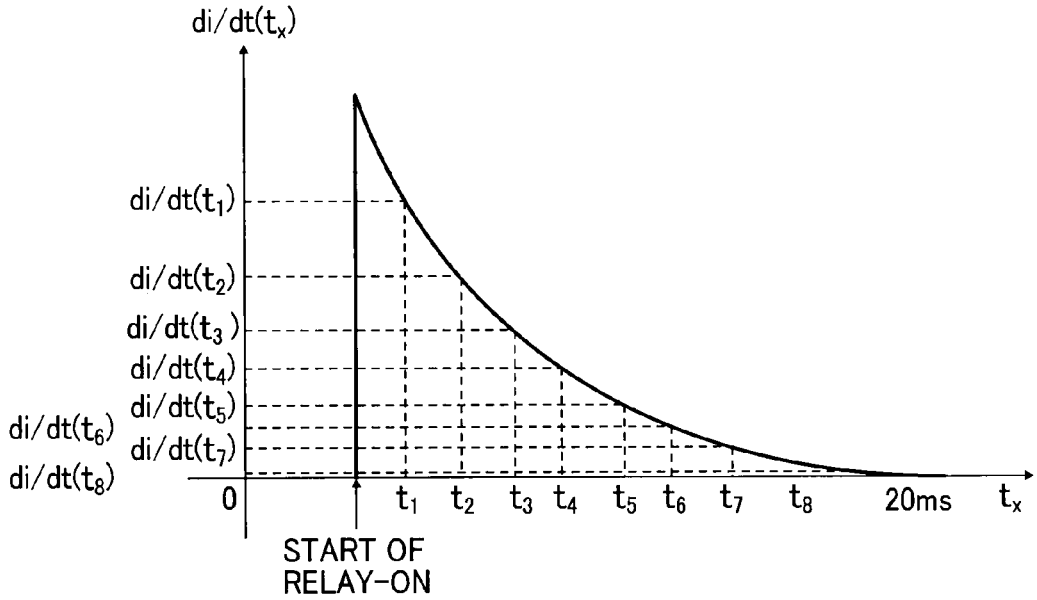
FIG. 5 is a graph representing a differentiated waveform corresponding to the current waveform illustrated in FIG. 3.

In FIG. 5 is illustrated a differentiated waveform corresponding to the current waveform illustrated in FIG. 3. As illustrated in FIG. 5, when a failure occurs in the shutdown relay 122, the differential values decrease uniformly with time. When a failure occurs in the shutdown relay 122, the position of the contact 124 remains the same. As a result, the inductance of the coil 126 also does not change. Hence, when it is detected that the differential values decrease uniformly with time (current values increase uniformly), the CPU 138 determines that the inductance of the coil 126 has not changed and thus detects that a failure has occurred in the relay. Moreover, irrespective of whether the failure in the shutdown relay 122 is a failure in which the relay does not close or a failure in which the relay does not open, the position of the contact 124 remains the same and the inductance of the coil 126 remains constant. Hence, the differential values decreases (current values increase) in a uniform manner.

Based on the differential values stored in the memory unit 140, the CPU 138 detects whether the inductance of the coil 126 has changed and accordingly detects whether a failure has occurred in the shutdown relay 122. Meanwhile, if a failure is detected in the shutdown relay 122, the CPU 138 can be configured to lead the current to an earth leakage circuit breaker, issue a breaking instruction, and stop the operations of the image forming apparatus 100. Moreover, the timing of detecting a failure in the shutdown can be set arbitrarily. For example, detection of a failure can be performed every time the image forming apparatus 100 starts up, or can be performed after a certain interval of time, or can be performed when the image forming apparatus 100 finishes operations.

The controller 150 controls the image forming apparatus 100 in entirety. When the control unit 134 detects a failure in the shutdown relay 122, the controller 150 instructs the operation display unit 152 to issue a failure warning.

Upon receiving the instruction from the controller 150, the operation display unit 152 issues a failure warning. For example, the operation display unit 152 displays, as illustrated in FIG. 6, a notification screen notifying that the shutdown operation cannot be performed normally; or displays, as illustrated in FIG. 7, a notification screen prompting the user to remove the power cord after the HDD writing process is complete.

Figure 8:
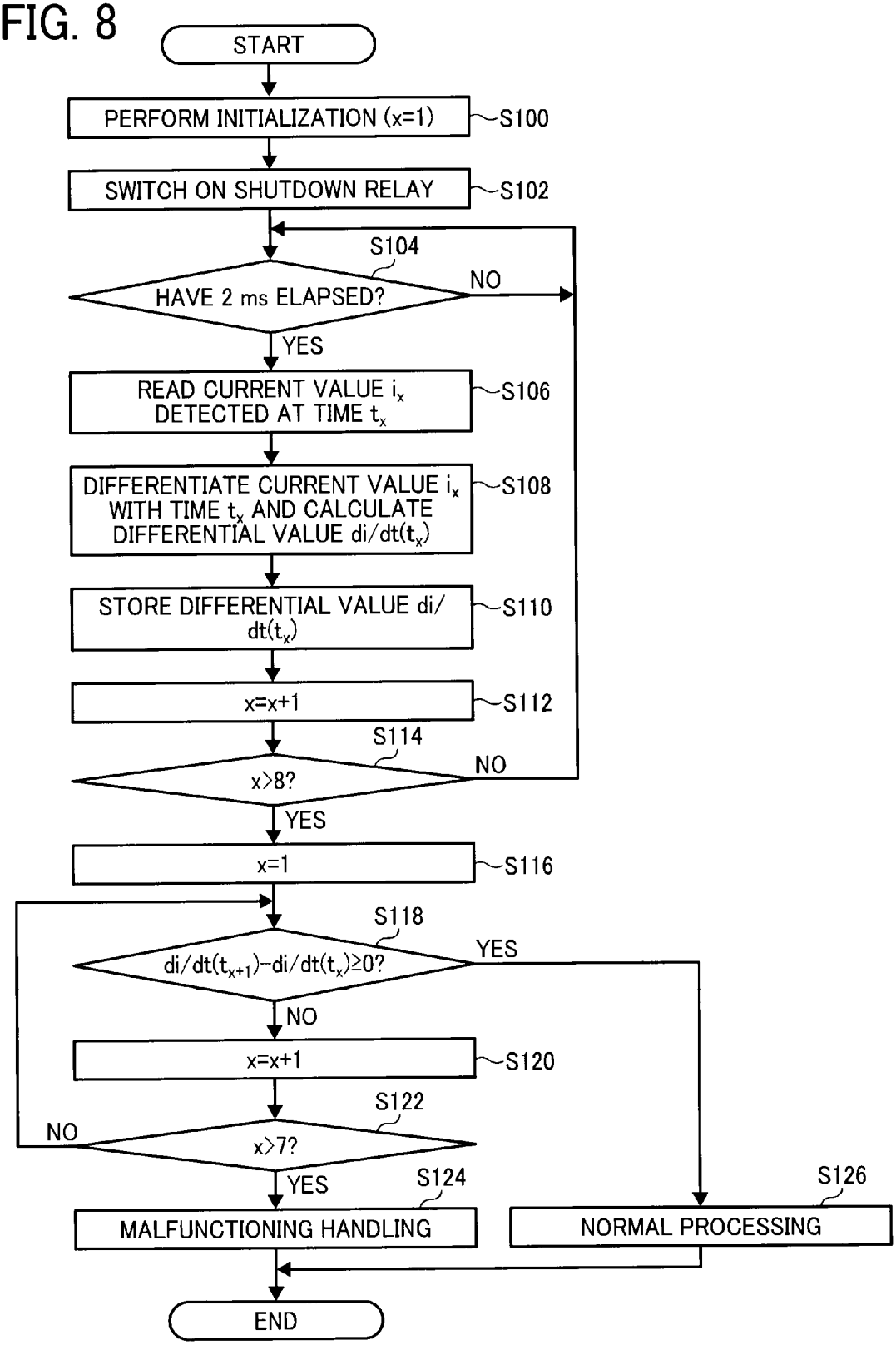
FIG. 8 is a flowchart for explaining an example of the operations performed by the image forming apparatus according to the first embodiment.

FIG. 8 is a flowchart for explaining an example of the operations performed by the image forming apparatus 100 according to the first embodiment. In the example illustrated in FIG. 8, the explanation is given for a case when the control unit 134 reads the current values, which have been detected by the current detecting circuit 132, for eight times at intervals of 2 ms, calculates the differential values by differentiating the current values that have been read for eight times, and accordingly detects a failure in the shutdown relay 122. However, herein, the reading interval or the reading count is not limited to the abovementioned case.

Firstly, the CPU 138 is initialized (Step S100). At that time, a variable x is set to 1.

Subsequently, the control unit 134 sends a relay-ON signal (an example of an instruction signal) to the relay drive element 130 for driving the relay drive element 130 so that the shutdown relay 122 is switched ON (Step S102). With that, the current detecting circuit 132 starts detecting the current values flowing in the coil 126.

Subsequently, the AD converter 136 waits for 2 ms (No at Step S104) and, after the elapse of 2 ms (Yes at Step S104), reads a current value $i_x$ that is detected at a time $t_x$ by the current detecting circuit 132 (Step S106).

Then, the CPU 138 differentiates the current value $i_x$, which is read by the AD converter 136, with the time $t_x$ and calculates a differential value $di/dt(t_x)$ (Step S108). Herein, the CPU 138 calculates the differential value $di/dt(t_x)$ as the rate of increase in the current value per reading interval (i.e., increased current value/reading interval).

Subsequently, the CPU 138 stores the calculated the differential value $di/dt(t_x)$ into the memory unit 140 (Step S110).

Then, the CPU 138 increments the variable x (Step S112) and, until the value of the variable x in the control unit 134 exceeds 8 (No at Step S114), repeats the operations from Step S104 to Step S110. Thus, in the first embodiment, the detection period for the control unit 134 is set to 16 ms starting from the transmission of the relay-ON signal. However, the detection period for the control unit can be of any length as long as it is longer than the period starting from the transmission of the relay-ON signal up to the closing of the contact 124.

Once the value of the variable x exceeds 8 (Yes at Step S114), the CPU 138 initializes the variable x to 1 (Step S116).

Subsequently, the CPU 138 determines whether a differential value $di/dt(t_{x+1})$ at a time $t_{x+1}$ and the differential value $di/dt(t_x)$ at the time $t_x$ have a difference value $di/dt(t_{x+1})-di/dt(t_x)$ equal to or greater than 0 (Step S118).

If the difference value $di/dt(t_{x+1})-di/dt(t_x)$ is determined to be smaller than 0 (No at Step S118), then the CPU 138 increments the variable x (Step S120) and, until the value of the variable x exceeds 7 (No at Step S122), repeats the operations from Step S118 to Step S120.

Once the value of the variable x exceeds 7 (Yes at Step S122), that is, when the difference value $di/dt(t_{x+1})-di/dt(t_x)$ is determined to be smaller than 0 for all seven times and when the differential values decrease uniformly with time (see FIG. 5); the CPU 138 detects a failure in the shutdown relay 122 and performs failure handling (Step S124). As far as the failure handling is concerned, the CPU 138 instructs, via the controller 150, the operation display unit 152 to issue a failure warning. Consequently, the operation display unit 152 displays, for example, a notification screen as illustrated in FIG. 6 or FIG. 7.

Meanwhile, before the value of the variable x exceeds 7, if the difference value $di/dt(t_{x+1})-di/dt(t_x)$ becomes equal to or greater than 0 (Yes at Step S118) (see FIG. 4); then the CPU 138 determines that the shutdown relay 122 is functioning normally and performs normal processing (Step S126).

As described above, in the first embodiment, since a failure in a relay is detected using a current detecting circuit mounted on the side of a coil of the relay, detection of a failure in the relay can be done without having to waste any electrical power. Moreover, according to the first embodiment, since the current detecting circuit is mounted on the side of the coil of the relay, the current values need not be sent from the side of the contact to the side of the coil in the relay. That eliminates the need to take into account a circuit that enables insulation of the circuit on the side of the contact from the circuit on the side of the coil. Furthermore, according to the first embodiment, the changes in the inductance of the internal coil of the relay are detected using the current detecting circuit mounted on the side of the coil. Hence, even in the case when a shutdown relay is mounted in parallel with an AC switch and when the AC switch is in the ON state, it becomes possible to detect a failure in the shutdown relay.

Meanwhile, it is also possible to dispose a filter in the current detecting circuit 132 so as to eliminate the chattering noise occurring immediately after the relay-ON signal is transmitted or the chattering noise occurring during the ON state of the contact 124. As a result, immediately after a relay-ON instruction is issued by the CPU 138, the AD converter 136 can start reading the current values. Besides, it also becomes possible to avoid false detection of the noise occurring immediately after the contact 124 is switched to the ON state.

In the first embodiment, a failure is detected by making use of the current values at the time when the relay switches from the OFF state to the ON state. However, alternatively, it is also possible to detect a failure in an identical manner when the relay switches from the ON state to the OFF state.

Second Embodiment

In a second embodiment according to the present invention, the explanation is given for a case when a failure in a relay is detected by comparing the differential values calculated from the current values with the differential values obtained during the previous calculation. The following explanation is given with the focus on the dissimilarity between the first embodiment and the second embodiment. Meanwhile, the constituent elements having the same function as described in the first embodiment are referred to by the same naming/symbols, and the explanation thereof is not repeated.

Figure 9:
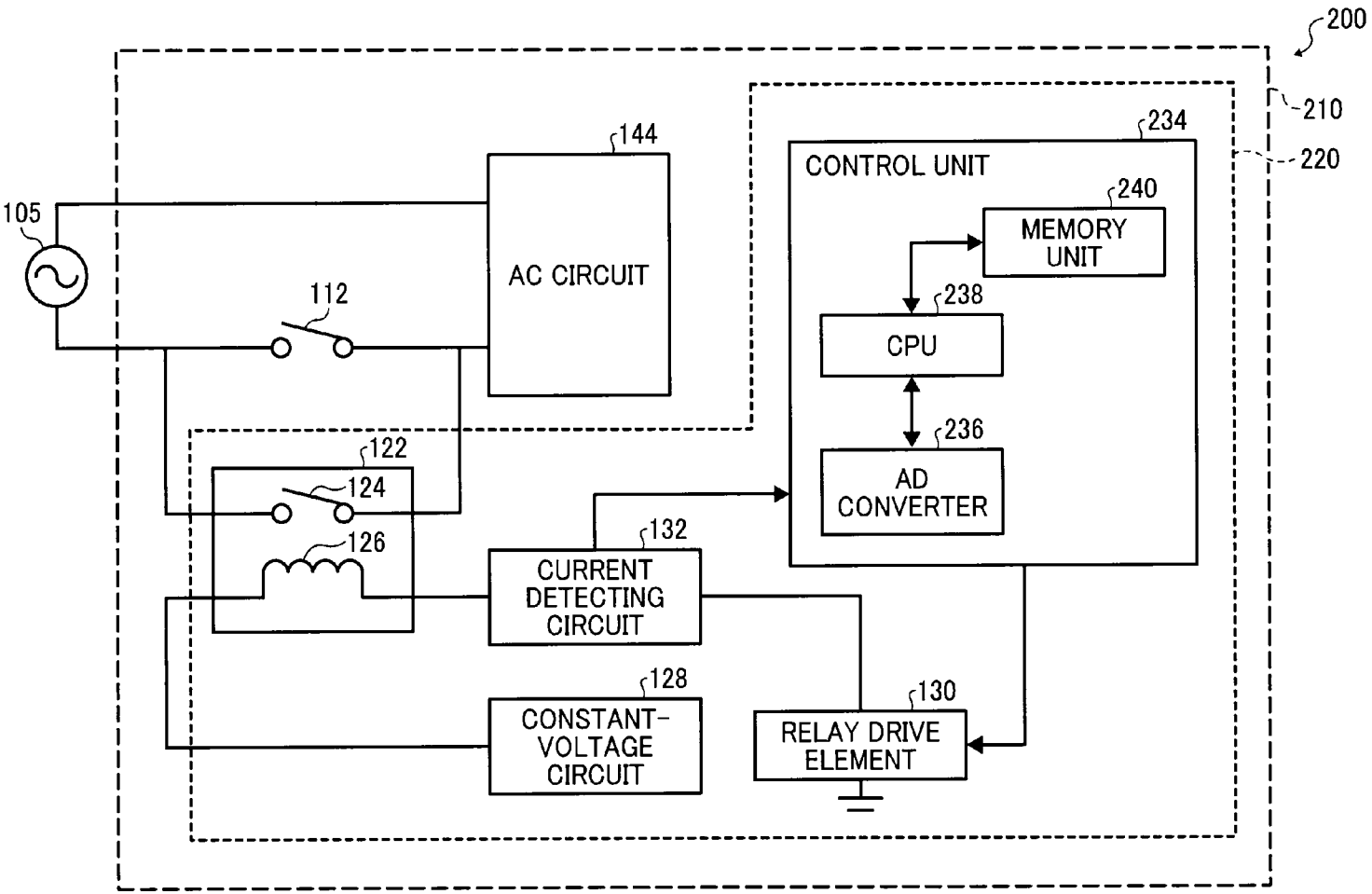
FIG. 9 is a block diagram of an exemplary configuration of an image forming apparatus according to a second embodiment of the present invention.

FIG. 9 is a block diagram of an exemplary configuration of a power-supply device 210 according to the second embodiment. An image forming apparatus 200 according to the second embodiment includes the power-supply device 210 in which a control unit 234 of a relay failure detecting device 220 differs from the control unit 134 according to the first embodiment.

In the control unit 234, the differential values obtained during the previous calculation by a CPU 238 are stored in a memory unit 240. The CPU 238 detects a failure in the relay by comparing the previously-calculated differential values with the newly-calculated differential values. More particularly, if the newly-calculated differential values are different than the previously-calculated differential values, the CPU 238 detects occurrence of a failure. Meanwhile, at the time of factory shipment, the memory unit 240 stores therein the differential values corresponding to the normal functioning of the relay. However, subsequent to the detection of a failure for the second time, the memory unit 240 stores therein the previously-calculated differential values.

Figure 10:
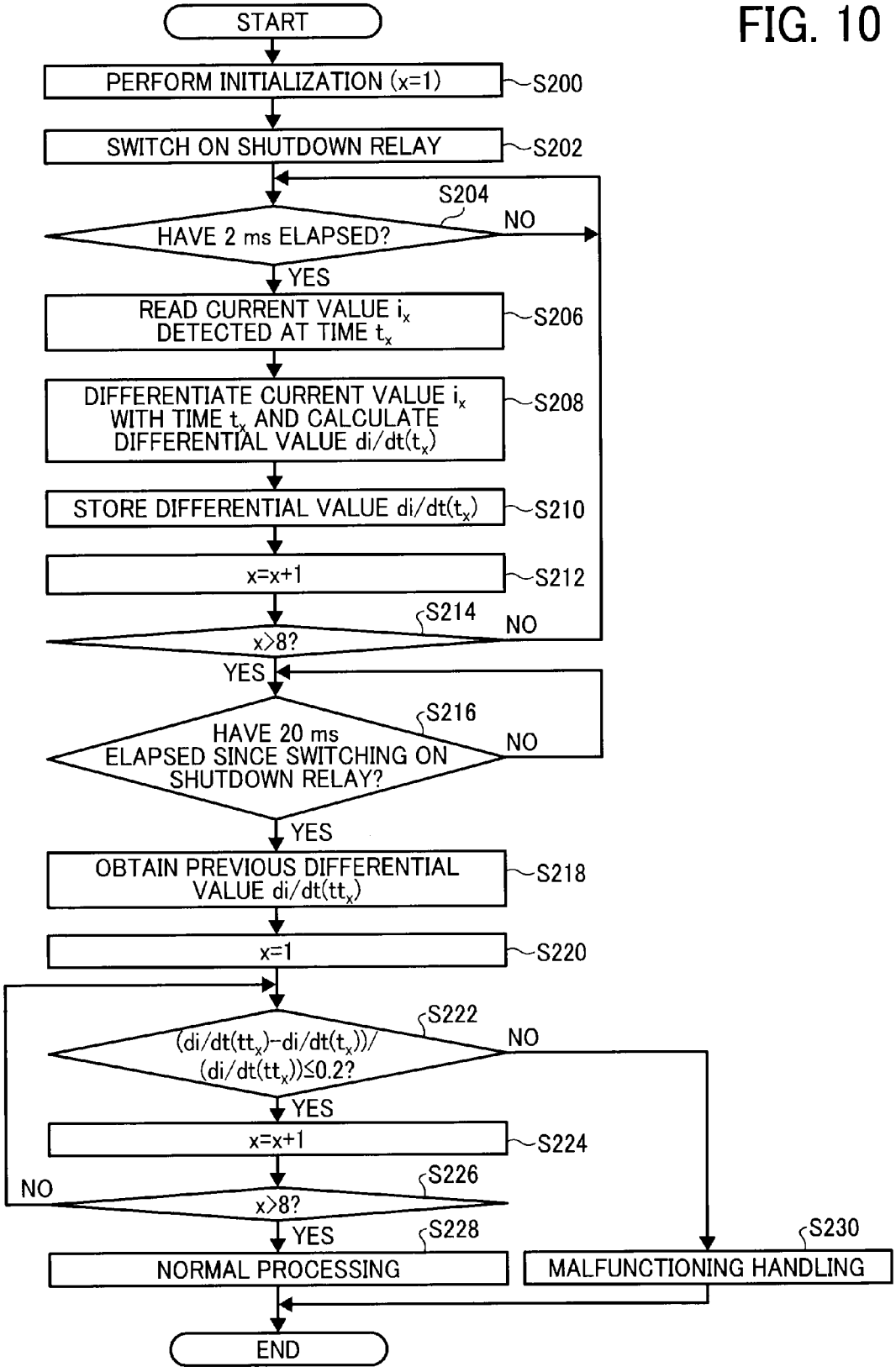
FIG. 10 is a flowchart for explaining an example of the operations performed by an image forming apparatus according to the second embodiment.

FIG. 10 is a flowchart for explaining an example of the operations performed by the image forming apparatus 200 according to the second embodiment.

Herein, the operations performed from Step S200 to Step S214 are identical to the operations performed from Step S100 to Step S114 as illustrated in the flowchart in FIG. 8. Hence, the explanation of those operations is not repeated.

Subsequently, when the value of the variable x exceeds 8 (Yes at Step S214) and after the elapse of 20 ms since the shutdown relay 122 is switched ON (Yes at Step S216), the CPU 238 obtains $di/dt(tt_x)$ as the previously-calculated differential value (Step S218).

Then, the CPU 238 initializes the variable x to 1 (Step S220).

Subsequently, regarding a differential value $di/dt(tt_{x+1})$ calculated previously at a time $tt_{x+1}$ and the differential value $di/dt(t_x)$ calculated newly at the time $t_x$, the CPU 238 determines whether the ratio $(di/dt(tt_x)-di/dt(t_x))/di/dt(tt_x)$ of the difference value therebetween is equal to or smaller than 0.2 (Step S222). Herein, although the difference value between the previously-calculated differential value and the newly-calculated difference value is assumed to have the ratio equal to or smaller than 0.2, the range is not limited to the same.

When the ratio $(di/dt(tt_x)-di/dt(t_x))/di/dt(tt_x)$ of the difference value is determined to be equal to or smaller than 0.2 (Yes at Step S222), the CPU 238 increments the variable x (Step S224) and, until the value of the variable x in the control unit 134 exceeds 8, repeats the operations from Step S222 to Step S224.

Once the value of the variable x exceeds 8 (Yes at Step S226), that is, when the ratio $(di/dt(tt_x)-di/dt(t_x))/di/dt(tt_x)$ of the difference value is determined to be equal to or smaller than 0.2 for all eight times; the CPU 238 determines that the shutdown relay 122 is functioning normally and performs normal processing (Step S228).

On the other hand, before the value of the variable x exceeds 8, if the ratio $(di/dt(tt_x)-di/dt(t_x))/di/dt(tt_x)$ of the difference value exceeds 0.2 (No at Step S222); then the CPU 238 detects a failure in the shutdown relay 122 and performs failure handling (Step S230).

Thus, according to the second embodiment too, it becomes possible to achieve the same effect as achieved according to the first embodiment. Meanwhile, the previous differential values stored in the memory unit 240 can also be sample data satisfying basic characteristics of the relay or can be the average of all differential values up to the previous differential values.

Third Embodiment

In a third embodiment according to the present invention, the explanation is given for a case when the failure detecting operation for a relay is corrected according to the changes in the current values that occur depending on the changes in the temperature. For example, as the temperature increases, the resistance value increases and the current value decreases. In contrast, as the temperature decreases, the resistance value decreases and the current value increases. The following explanation is given with the focus on the dissimilarity between the first embodiment and the third embodiment. Meanwhile, the constituent elements having the same function as described in the first embodiment are referred to by the same naming/symbols, and the explanation thereof is not repeated.

Figure 11:
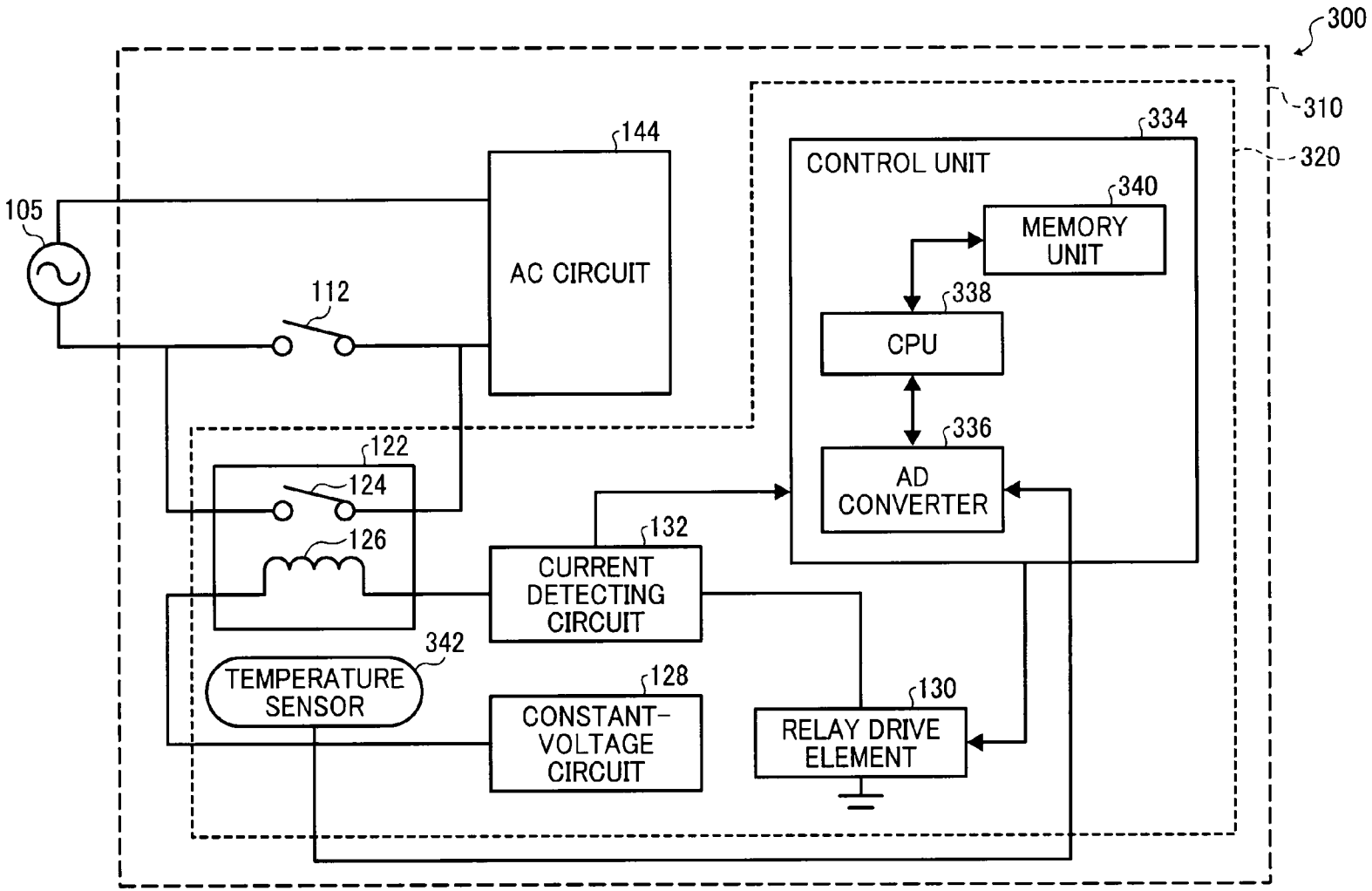
FIG. 11 is a block diagram of an exemplary configuration of a power-supply device according to a third embodiment of the present invention.

FIG. 11 is a block diagram of an exemplary configuration of a power-supply device 310 according to the third embodiment. An image forming apparatus 300 according to the third embodiment includes the power-supply device 310, in which a relay failure detecting device 320 additionally includes a temperature sensor 342 and includes a control unit 334 that differs from the control unit 134 according to the first embodiment.

The temperature sensor 342 is disposed near the shutdown relay 122, and detects the temperature of the shutdown relay 122 and outputs it to an AD converter 336 of the control unit 334. Herein, the AD converter 336 can be identical to an AD converter used for reading the current values detected by the current detecting circuit 132 or can be a different type of converter.

Regarding the current values at normal temperature that are read by the AD converter 336 from the current detecting circuit 132, a CPU 338 differentiates those current values and stores the differential values in the form of a table in a memory unit 340. Then, the CPU 338 compares the differential values stored in the memory unit 340 with the newly-calculated differential values, and, when the compared values differ substantially, corrects a threshold value that is set for the difference value $di/dt(t_{x+1})-di/dt(t_x)$ obtained between the differential value $di/dt(t_{x+1})$ at the time $t_{x+1}$ and the differential value $di/dt(t_x)$ at the time $t_x$. For example, in the first embodiment, that threshold value is assumed to be 0. However, at a low temperature, since the current increases as well as the different values increase, correction is made to increase the threshold value. As a result, it becomes possible to avoid false detection of a failure in the relay that may be falsely detected due to changes in the temperature.

Meanwhile, instead of correcting the threshold value, it is also possible to correct the current values or the differential values. Moreover, the memory unit 340 can be used to store, in the form of a table, the current values at normal temperature that are read by the AD converter 336 from the current detecting circuit 132. In that case, the CPU 338 can compare the new current values with the current values stored in the memory unit 340, and determine the need for correction. Herein, the correction can be performed at the timing just before the detection of a failure.

Fourth Embodiment

In the first embodiment, the explanation is given for detecting a failure in a shutdown relay that is used for breaking an AC circuit. In a fourth embodiment according to the present invention, the explanation is given for detecting a failure in a shutdown relay that is used for breaking a DC circuit. The following explanation is given with the focus on the dissimilarity between the first embodiment and the fourth embodiment. Meanwhile, the constituent elements having the same function as described in the first embodiment are referred to by the same naming/symbols, and the explanation thereof is not repeated.

Figure 12:
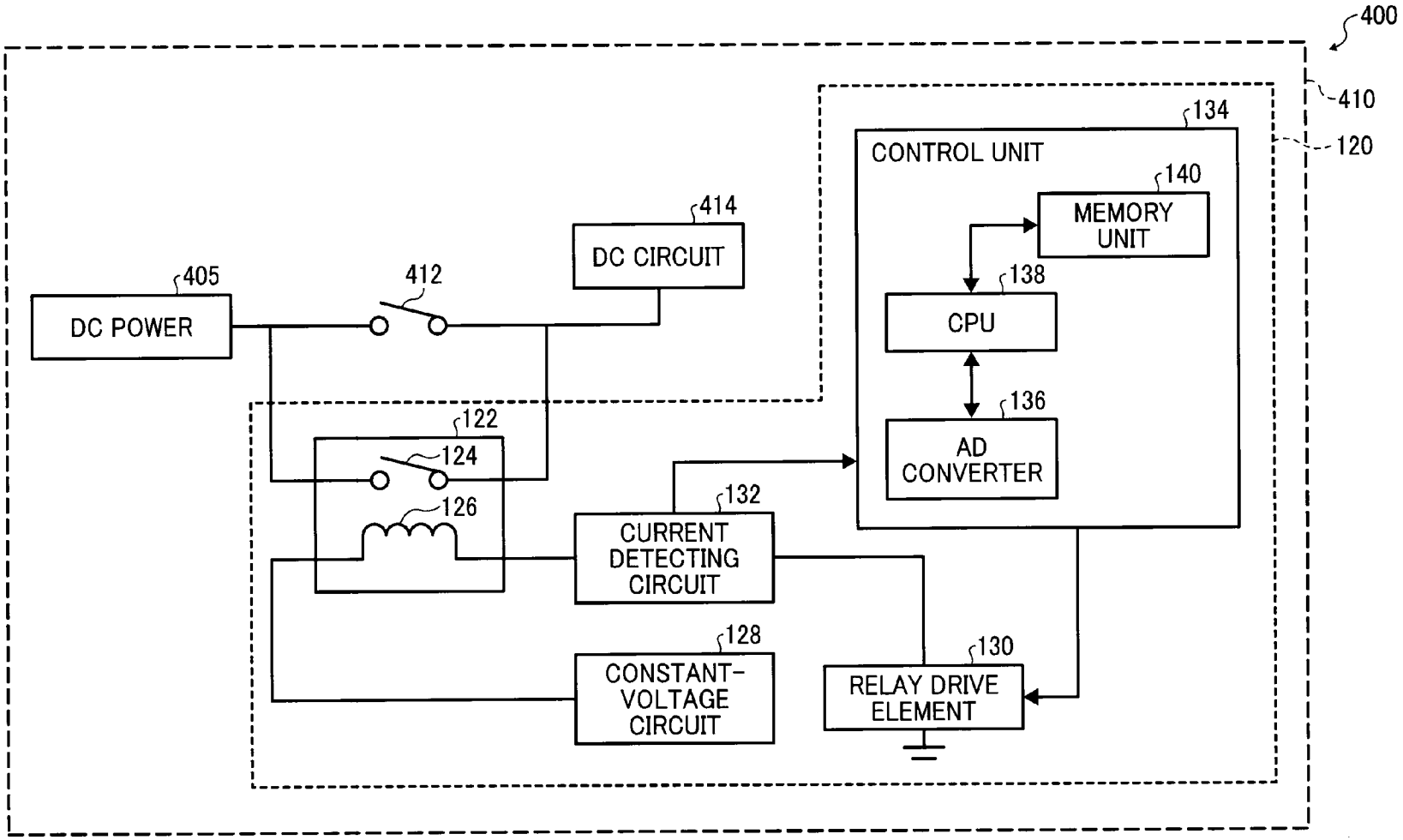
FIG. 12 is a block diagram of an exemplary configuration of a power-supply device according to a fourth embodiment of the present invention.

FIG. 12 is a block diagram of an exemplary configuration of a power-supply device 410 according to the fourth embodiment. An image forming apparatus 400 according to the fourth embodiment includes the power-supply device 410 which differs from the first embodiment in the fact that the AC switch and the AC circuit are replaced by a DC switch 412, a DC circuit 414, and a DC power 405. Meanwhile, since the details regarding the relay failure detecting device 120 are same as those described in the first embodiment, the explanation is not repeated.

In this way, even if a failure is detected in a shutdown relay that breaks not an AC circuit but a DC circuit, it is still possible to achieve the same effect as achieved according to the first embodiment.

Fifth Embodiment

In a fifth embodiment according to the present invention, the explanation is given for a case of detecting a failure in a relay by making use of hardware. The following explanation is given with the focus on the dissimilarity between the first embodiment and the fifth embodiment. Meanwhile, the constituent elements having the same function as described in the first embodiment are referred to by the same naming/symbols, and the explanation thereof is not repeated.

Figure 13:
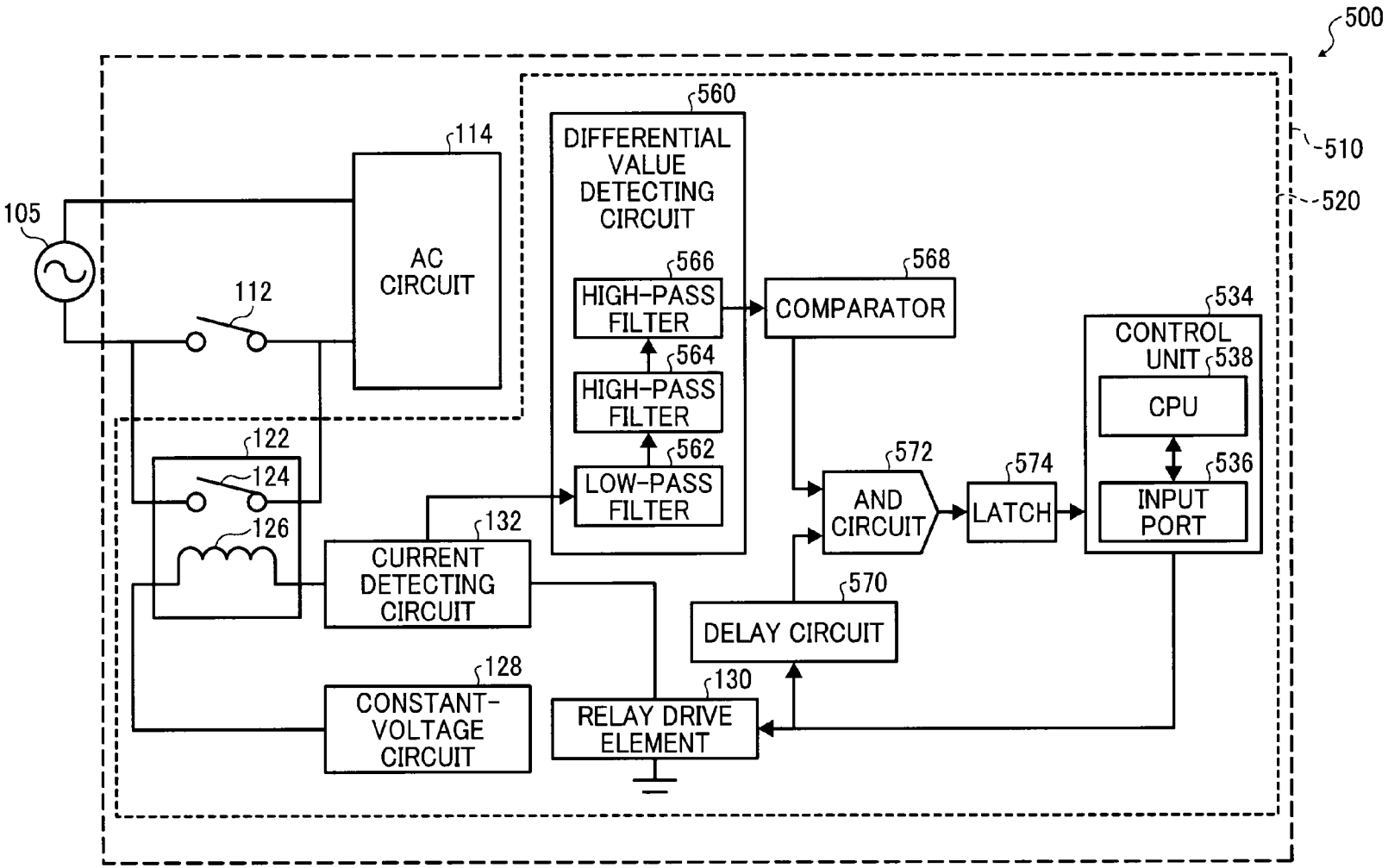
FIG. 13 is a block diagram of an exemplary configuration of a power-supply device according to a fifth embodiment of the present invention.

FIG. 13 is a block diagram of an exemplary configuration of a power-supply device 510 according to the fifth embodiment. An image forming apparatus 500 according to the fifth embodiment includes the power-supply device 510 in which a relay failure detecting device 520 includes a differential value detecting circuit 560, a comparator 568, a delay circuit 570, an AND circuit 572, and a latch 574 that are not present in the first embodiment. Moreover, the relay failure detecting device 520 includes a control unit 534 that is different than the control unit 134 according to the first embodiment.

The differential value detecting circuit 560 (an example of a differentiating unit) includes a low-pass filter 562 and two high-pass filters 564 and 566 so as to eliminate the chattering noise from a current value, which has been input from the current detecting circuit 132, before outputting the current value.

Figure 14:
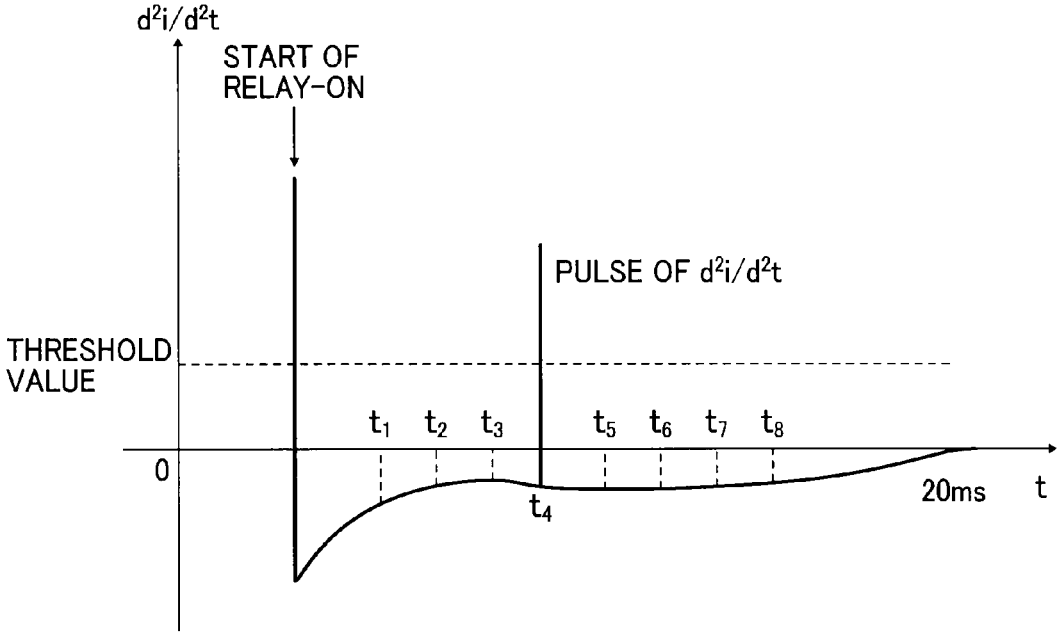
FIG. 14 is a graph representing an exemplary differentiated waveform that is output when the current waveform illustrated in FIG. 2 is input to a differential value detecting circuit according to the fifth embodiment.
Figure 15:
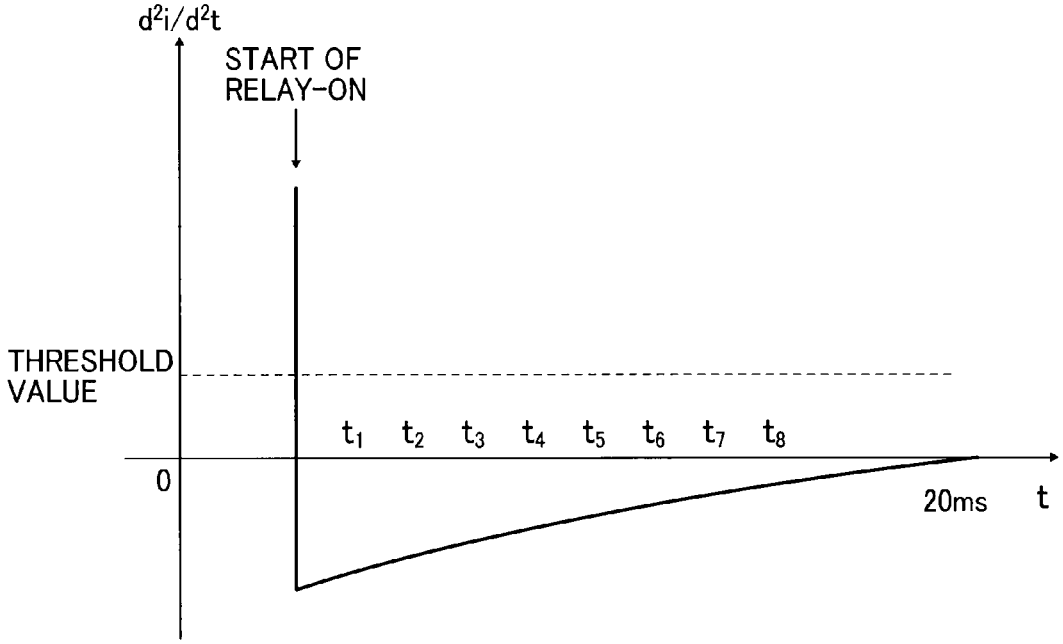
FIG. 15 is a graph representing an exemplary differentiated waveform that is output when the current waveform illustrated in FIG. 3 is input to the differential value detecting circuit according to the fifth embodiment.

In FIG. 14 is illustrated a differentiated waveform that is output when the current waveform illustrated in FIG. 2 is input to the differential value detecting circuit 560. As illustrated in FIG. 14, when the shutdown relay 122 is functioning normally, the differentiated waveform is output by the differential value detecting circuit 560 in which a pulse generates in onset of the relay-ON state and at the time of opening and closing of the contact. In FIG. 15 is illustrated a differentiated waveform that is output when the current waveform illustrated in FIG. 3 is input to the differential value detecting circuit 560. As illustrated in FIG. 15, when a failure occurs in the shutdown relay 122, the differentiated waveform is output by the differential value detecting circuit 560 in which a pulse generates only in onset of the relay-ON state.

Thus, if a pulse (a pulse of d2i/d2t) are detected from the differentiated waveform output by the differential value detecting circuit 560, the shutdown relay 122 can be determined to be functioning normally. On the other hand, if a pulse (a pulse of d2i/d2t) is not detected from the differentiated waveform output by the differential value detecting circuit 560, a failure can be determined to have occurred in the shutdown relay 122.

The comparator 568 performs comparator output of the pulse output by the differential value detecting circuit 560. The delay circuit 570 delays, by a few milliseconds, the relay-ON signal transmitted by the control unit 534. The AND circuit 572 obtains a logical product of the comparator output from the comparator 568 and the relay-ON signal delayed by the delay circuit 570. The latch 574 latches the output from the AND circuit 572 and inputs the same to an input port 536 of the control unit 534.

In this way, since the delay circuit 570 delays the relay-ON signal and the AND circuit 572 obtains a logical product of the comparator output and the relay-ON signal, the pulse generated in onset of the relay-ON state is not input to the input port 536.

A CPU 538 detects a failure in the relay depending on whether the pulse has been input to the input port 536.

Figure 16:
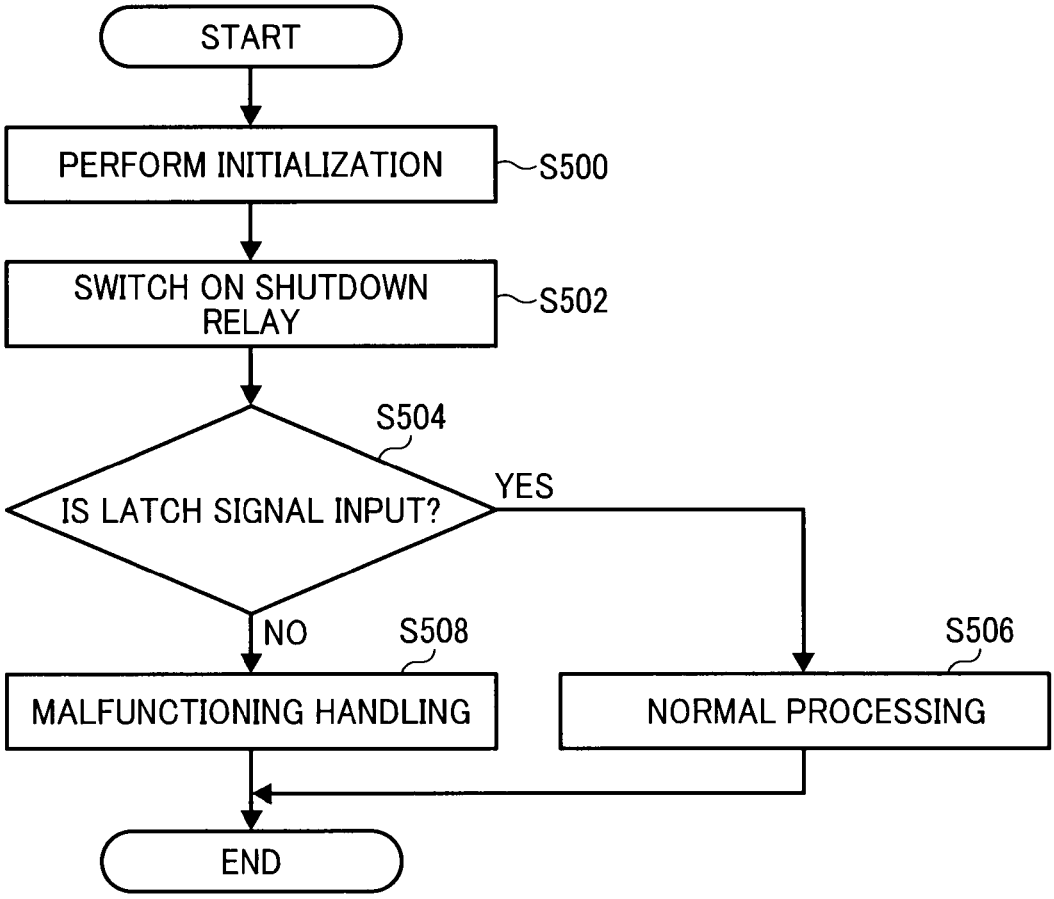
FIG. 16 is a flowchart for explaining an example of the operations performed by an image forming apparatus according to the fifth embodiment.

FIG. 16 is a flowchart for explaining an example of the operations performed by the image forming apparatus 500 according to the fifth embodiment.

Herein, the operations performed in Steps S500 and S502 are identical to the operations performed in Steps S100 and S102 as illustrated in the flowchart in FIG. 8. Hence, the explanation of those operations is not repeated.

When the control unit 534 transmits the relay-ON signal, the CPU 538 monitors the input to the input port 536 for a predetermined period of time such as 20 ms.

If a latch signal is input to the input port 536 (Yes at Step S504), the CPU 538 determines that the shutdown relay 122 is functioning normally and performs normal processing (Step S506).

On the other hand, if a latch signal is not input to the input port 536 (No at Step S504), the CPU 338 detects a failure in the shutdown relay 122 and performs failure handling (Step S508).

Meanwhile, alternatively, it is also possible to directly input the latch signal to an interrupt port of the control unit 534, and interrupt handling can be used for failure handling performed when a failure is detected in the shutdown relay 122. Moreover, regarding the threshold value of the latch signal, the settings can be arbitrarily done so as to avoid false detection due to noise. Herein, the threshold value can be appropriately set by means of varying the reference voltage of the comparator output.

Thus, according to the fifth embodiment too, it is possible to achieve the same effect as achieved according to the first embodiment.

Sixth Embodiment

In a sixth embodiment according to the present invention, the explanation is given for a case when a latching relay is used as the shutdown relay. In an image forming apparatus according to the sixth embodiment, in a relay capable of retaining the contact state as that of a latching relay, a failure in the relay is detected by referring to the relation of the voltage/current flowing in the coil and by determining whether the contact is in the in-contact state or in the out-of-contact state. The following explanation is given with the focus on the dissimilarity between the first embodiment and the sixth embodiment. Meanwhile, the constituent elements having the same function as described in the first embodiment are referred to by the same naming/symbols, and the explanation thereof is not repeated.

Figure 17:
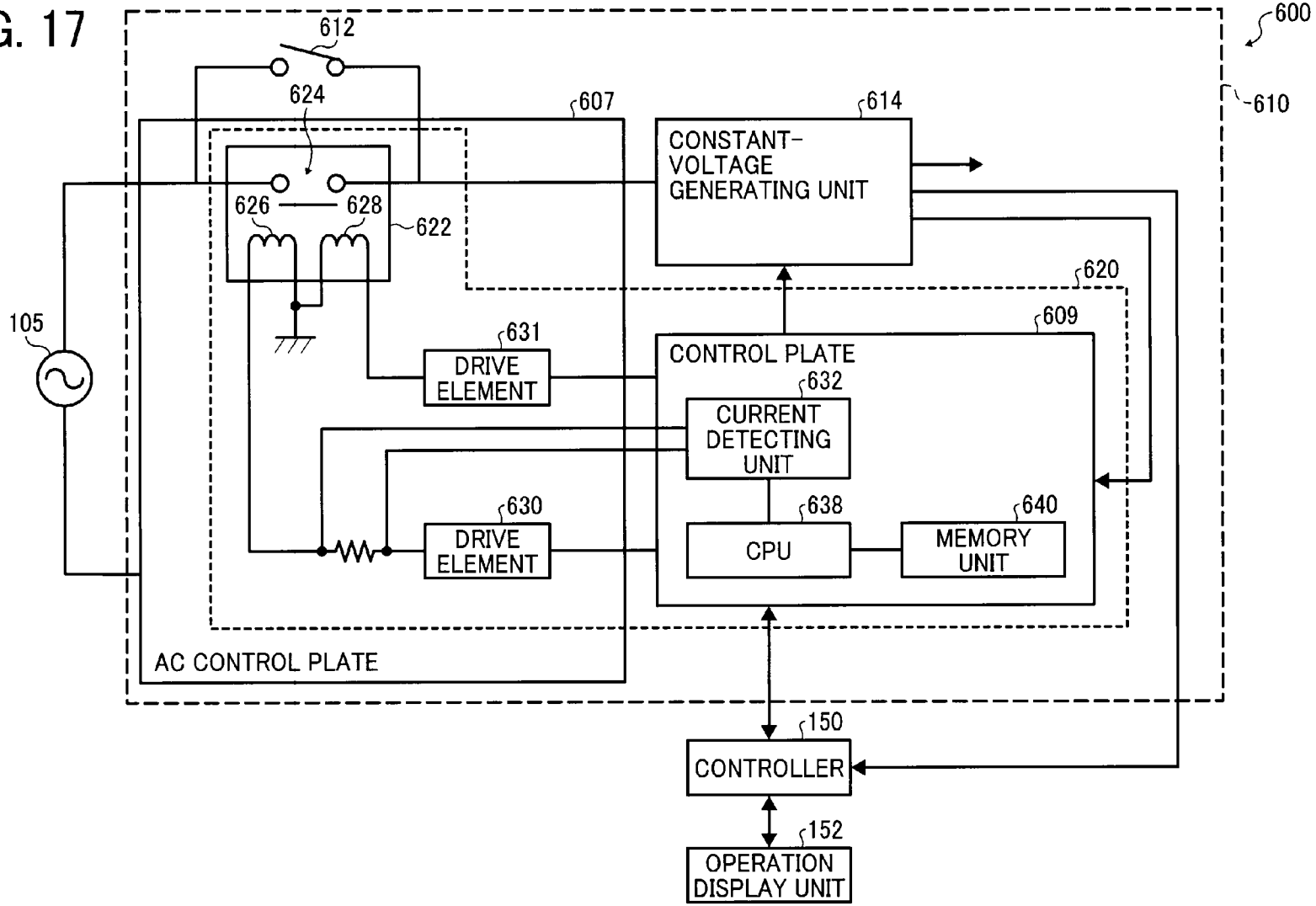
FIG. 17 is a block diagram of an exemplary configuration of an image forming apparatus according to a sixth embodiment of the present invention.

FIG. 17 is a block diagram of an exemplary configuration of an image forming apparatus 600 according to the sixth embodiment. As illustrated in FIG. 17, the image forming apparatus 600 includes a power-supply device 610, the controller 150, and the operation display unit 152. The power-supply device 610 includes an AC switch 612, a constant-voltage generating unit 614, and a relay failure detecting device 620. Moreover, the relay failure detecting device 620 includes a shutdown relay 622, drive elements 630 and 631, a current detecting unit 632, a CPU 638, and a memory unit 640. Herein, the shutdown relay 622 and the drive elements 630 and 631 are mounted on an AC control plate 607; while the current detecting unit 632, the CPU 638, and the memory unit 640 are mounted on a control plate 609.

The AC switch 612 is used for switching ON or switching OFF the supply of current from the AC power 105 to the AC control plate 607. Herein, the AC switch 612 can be a mechanical switch or a semiconductor switch.

When the AC switch 612 is switched ON thereby allowing the current to flow to the AC control plate 607, the constant-voltage generating unit 614 supplies power to the control plate 609 and the controller 150.

The shutdown relay 622 is mounted in parallel with the AC switch 612 and is formed using a latching relay. The shutdown relay 622 includes an electromagnetic switch element 624 for opening and closing the current pathway and includes a set coil 626 and a reset coil 628 for driving the switch element 624 with the aim of switching the shutdown relay 622 between ON and OFF states.

The drive elements 630 and 631 respectively pass a current to the set coil 626 and the reset coil 628 for the purpose of opening and closing the switch element 624 and switching the shutdown relay 622 between ON and OFF states. Meanwhile, although the drive elements 630 and 631 are mounted on the AC control plate 607, it is possible to mount them at arbitrary mountable positions.

The current detecting unit 632 is inserted in series with the set coil 626 and the drive element 630, and detects the current flowing to the set coil 626. When the shutdown relay 622 is functioning normally and when the contact thereof switches from the closed state to the open state, the current values flowing in the set coil 626 are same as illustrated in FIG. 2. Besides, when the contact of the shutdown relay 622 is in the closed state, the current values flowing in the set coil 626 are same as illustrated in FIG. 3. In the sixth embodiment, although the current flowing only in the set coil 626 is detected, it is also possible to detect the current flowing only in the reset coil 628 or the current flowing in both the set coil 626 and the reset coil 628.

The CPU 638 drives the drive elements 630 and 631, and calculates differential values by differentiating the current values that have been detected by the current detecting unit 632 and subjected to analog-to-digital conversion performed by an AD converter (not illustrated). The memory unit 640 is used to store the differential values calculated by the CPU 638. Meanwhile, the differentiated waveforms obtained by differentiating the current waveforms illustrated in FIGS. 2 and 3 are respectively identical to the differentiated waveforms illustrated in FIGS. 4 and 5. Based on the differential values stored in the memory unit 640, the CPU 638 detects whether the inductance of the set coil 626 has changed and accordingly detects whether a failure has occurred in the shutdown relay 622.

Figure 18:
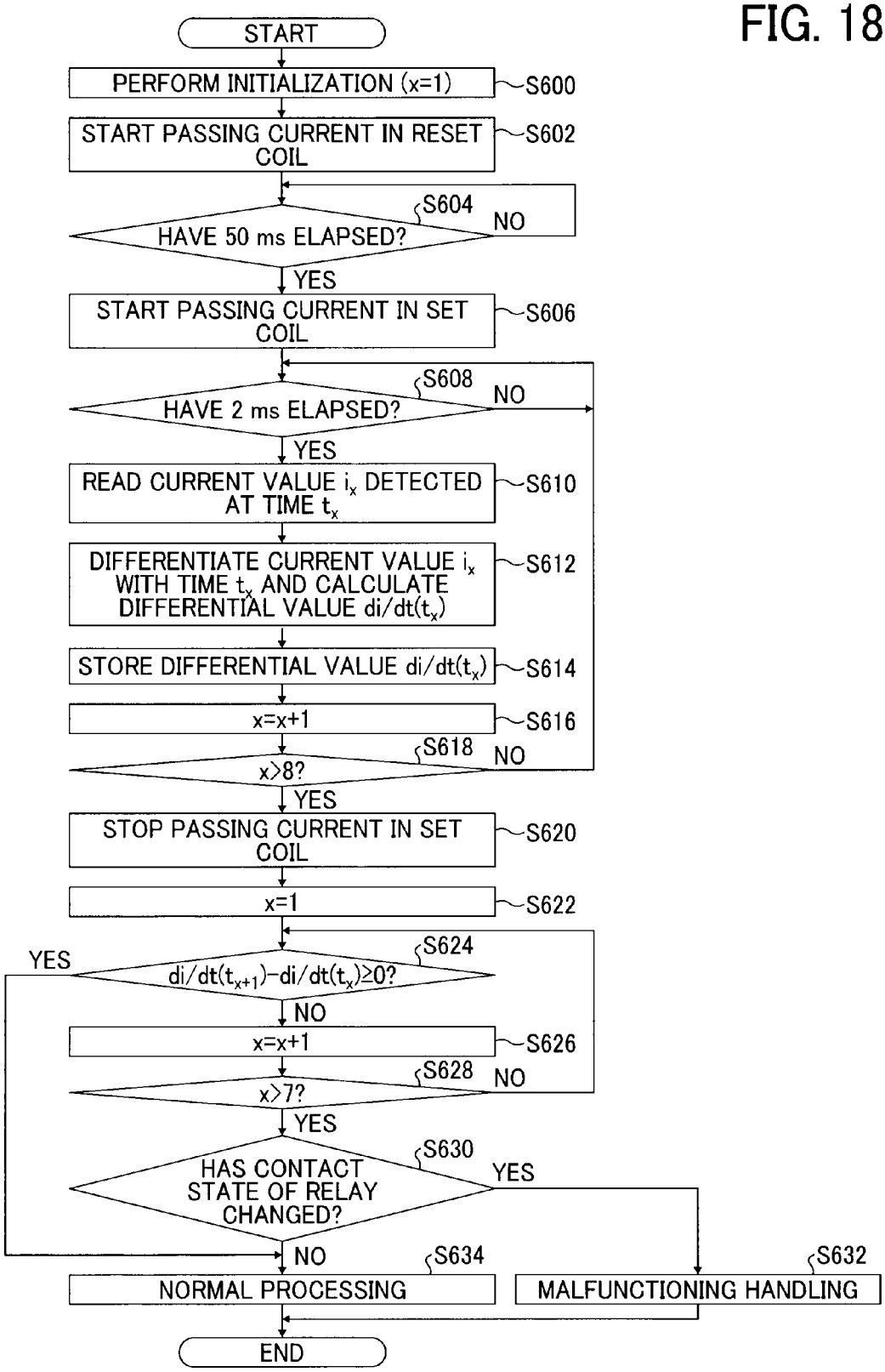
FIG. 18 is a flowchart for explaining an example of the operations performed by the image forming apparatus according to the sixth embodiment.

FIG. 18 is a flowchart for explaining an example of the operations performed by the image forming apparatus 600 according to the sixth embodiment.

Firstly, the CPU 638 is initialized (Step S600). At that time, the variable x is set to 1.

Subsequently, the CPU 638 drives the drive element 631 so as to pass a current in the reset coil 628 (Step S602). In that case, the CPU 638 drives the reset coil 628 and performs failure detection of the shutdown relay 622 after once closing the contact. However, in the case when the contact state is recognizable, the operation at Step S602 can be skipped.

Then, the CPU 638 waits for 50 ms (No at Step S604) and, after the elapse of 50 ms, drives the drive element 630 so as to pass a current in the set coil 626 (Step S606).

The subsequent operations from Step S608 to Step S618 are identical to the operations performed from Step S104 to Step S114 as illustrated in the flowchart in FIG. 8. Hence, the explanation of those operations is not repeated.

Subsequently, the CPU 638 stops driving the drive element 630 so as to stop passing a current to the set coil 626 (Step S620).

The subsequent operations from Step S622 to Step S628 are identical to the operations performed from Step S116 to Step S122 as illustrated in the flowchart in FIG. 8. Hence, the explanation of those operations is not repeated.

Once the value of the variable x exceeds 7 (Yes at Step S628), that is, when the difference value $di/dt(t_{x+1})-di/dt(t_x)$ is determined to be smaller than 0 for all seven times and when the differential values decrease uniformly with time (see FIG. 5); the CPU 638 checks whether the contact state of the shutdown relay 622 has changed (Step S630). That is because, the case of obtaining Yes at Step S628 can be a case when the shutdown relay 622 is in the failure state and a current is passed in the set coil 626 so as to change the contact of the shutdown relay 622 from the open state to the closed state, or can be a case when a current is passed in either the set coil 626 or the reset coil 628 so as to change the contact of the shutdown relay 622 to an identical state from either the open state or the close state.

If the contact state of the shutdown relay 622 has changed (Yes at Step S630), then the CPU 638 detects a failure in the shutdown relay 622 and performs failure handling (Step S132). On the other hand, if the contact state of the shutdown relay 622 has not changed (No at Step S630), then the CPU 638 determines that the shutdown relay 622 is functioning normally and performs normal processing (Step S634).

Meanwhile, before the value of the variable x exceeds 7, if the difference value $di/dt(t_{x+1})-di/dt(t_x)$ becomes equal to or greater than 0 (Yes at Step S624) (see FIG. 4); the CPU 638 determines that the shutdown relay 122 is functioning normally and performs normal processing (Step S634). The case of obtaining Yes at Step S624 is the case when the transition of the contact of the shutdown relay 622 from the open state to the closed state is normal.

Thus, according to the sixth embodiment too, it is possible to achieve the same effect as achieved according to the first embodiment. Particularly, in the sixth embodiment, since a latching relay is used as the shutdown relay, it is possible to reduce the consumption current. Moreover, by using a latching relay as the shutdown relay, the need for switching the coil between ON and OFF states is eliminated, and a failure can be detected by applying a pulse voltage to the coil and monitoring the difference of the change in the current.

Meanwhile, in the sixth embodiment, as a method of once passing a current in the reset coil 628 and then passing a current in the set coil 626 at the time of starting failure detection, a failure is detected according to the current value at the time when the relay contact of the shutdown relay 622 switches from the open state to the closed state. However, alternatively, in order to check the contact state of the relay, passing of a current in the set coil 626 and the reset coil 628 can be controlled. For example, in order to check whether the contact is in the closed state, the voltage at the pulse can be applied to the set coil and the change in the current at that time can be read.

Moreover, in the sixth embodiment too, in an identical manner to that described in the third embodiment, the failure detecting operation for a relay can be corrected according to the changes in the current values that occur depending on the changes in the temperature. Furthermore, in an identical manner to that described in the fourth embodiment, the sixth embodiment can also be implemented for detecting a failure in a shutdown relay that is used for breaking a DC circuit.

Seventh Embodiment

In a seventh embodiment according to the present invention, the explanation is given for a case when a latching relay is used as the shutdown relay and when a failure in the relay is detected by comparing the differential values calculated from the current values with the differential values obtained during the previous calculation. The following explanation is given with the focus on the dissimilarity between the sixth embodiment and the seventh embodiment. Meanwhile, the constituent elements having the same function as described in the sixth embodiment are referred to by the same naming/symbols, and the explanation thereof is not repeated.

Figure 19:
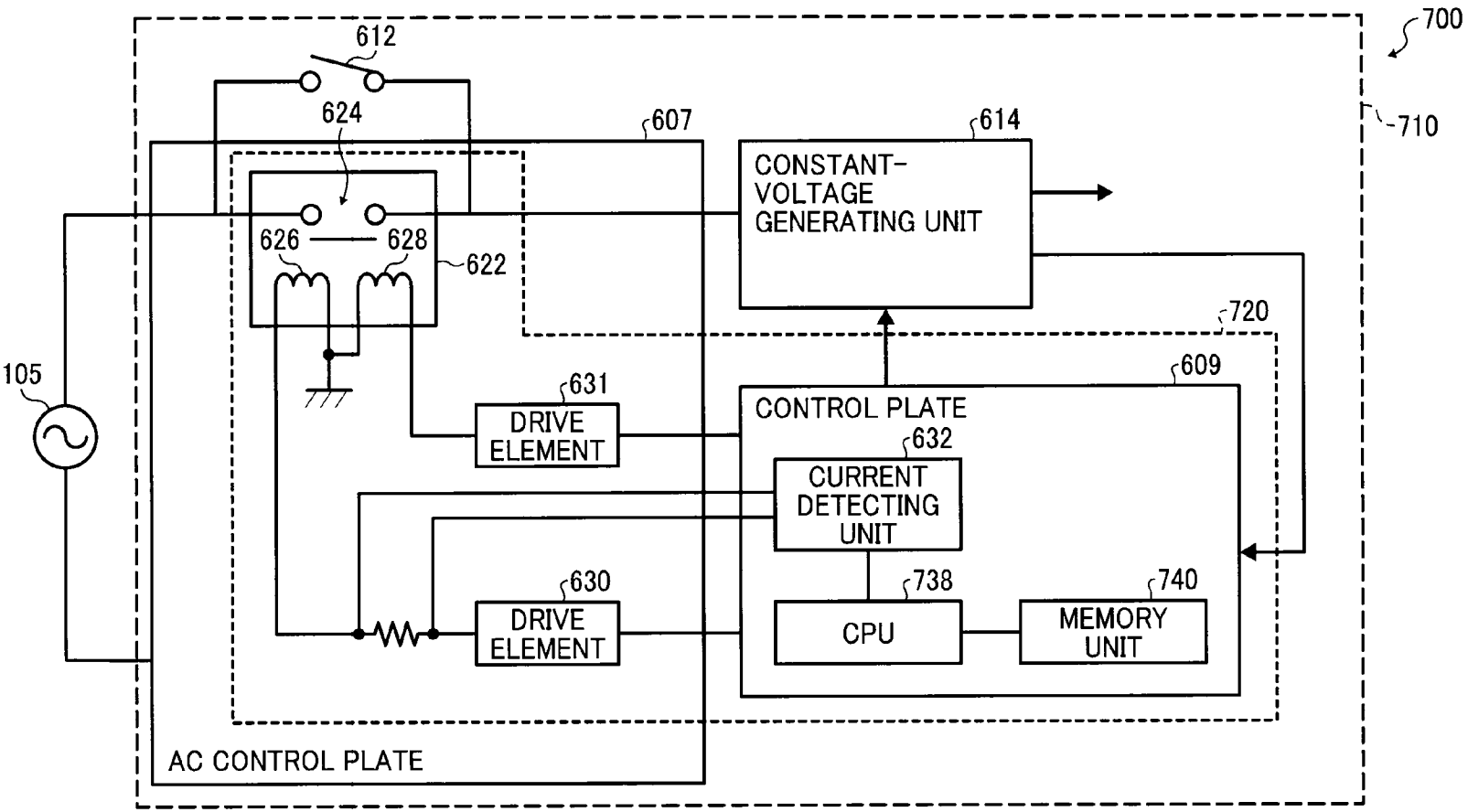
FIG. 19 is a block diagram of an exemplary configuration of a power-supply device according to a seventh embodiment of the present invention.

FIG. 19 is a block diagram of an exemplary configuration of a power-supply device 710 according to the seventh embodiment. An image forming apparatus 700 according to the seventh embodiment includes the power-supply device 710, in which a CPU 738 and a memory unit 740 of a relay failure detecting unit 720 are respectively different than the CPU 138 and the memory unit 140 according to the first embodiment.

The differential values obtained during the previous calculation by the CPU 738 are stored in the memory unit 740. The CPU 738 detects a failure in the relay by comparing the previously-calculated differential values with the newly-calculated differential values. More particularly, the CPU 738 detects a failure if the newly-calculated differential values are different than the previously-calculated differential values. However, if the contact is already open at the time of starting the detection, the CPU 738 determines that the relay is functioning normally. Meanwhile, at the time of factory shipment, the memory unit 740 stores therein the differential values corresponding to the normal functioning of the relay. However, in the detection of a failure for the second and the subsequent time, the memory unit 740 stores therein the previously-calculated differential values.

Figure 20:
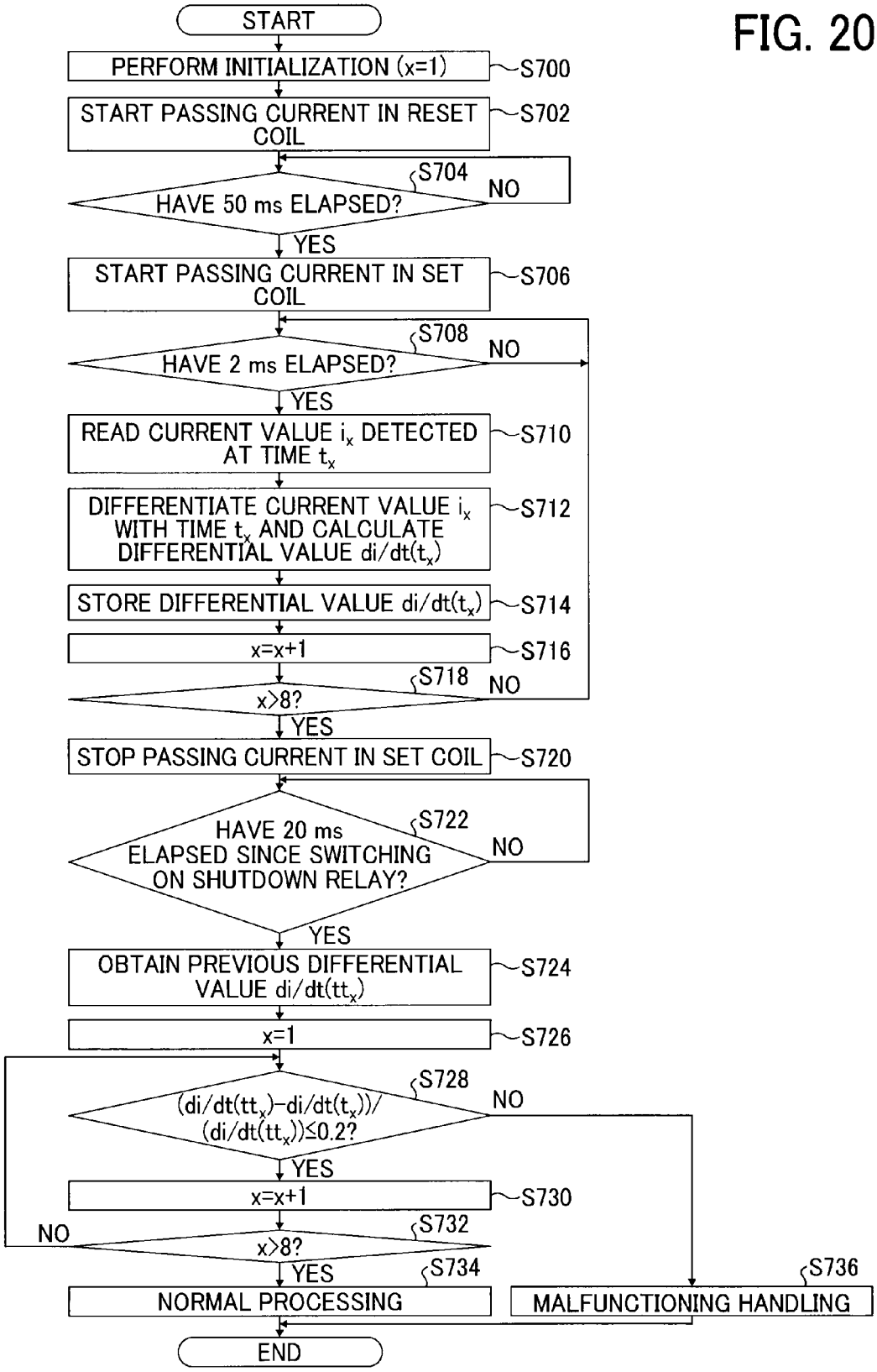
FIG. 20 is a flowchart for explaining an example of the operations performed by an image forming apparatus according to the seventh embodiment.

FIG. 20 is a flowchart for explaining an example of the operations performed by the image forming apparatus 700 according to the seventh embodiment.

Herein, the operations performed from Step S700 to Step S720 are identical to the operations performed from Step S600 to Step S620 as illustrated in the flowchart in FIG. 18. Hence, the explanation of those operations is not repeated.

Similarly, the operations performed from Step S722 to Step S736 are identical to the operations performed from Step S216 to Step S230 as illustrated in the flowchart in FIG. 10. Hence, the explanation of those operations is not repeated.

Thus, according to the seventh embodiment too, it is possible to achieve the same effect as achieved according to the sixth embodiment. Meanwhile, the previous differential values stored in the memory unit 740 can also be sample data satisfying basic characteristics of the relay or can be the average of all differential values up to the previous differential values.

Eighth Embodiment

In an eighth embodiment according to the present invention, the explanation is given for a case when a latching relay is used as the shutdown relay and a failure in the relay is performed by making use of hardware. The following explanation is given with the focus on the dissimilarity between the sixth embodiment and the eighth embodiment. Meanwhile, the constituent elements having the same function as described in the sixth embodiment are referred to by the same naming/symbols, and the explanation thereof is not repeated.

Figure 21:
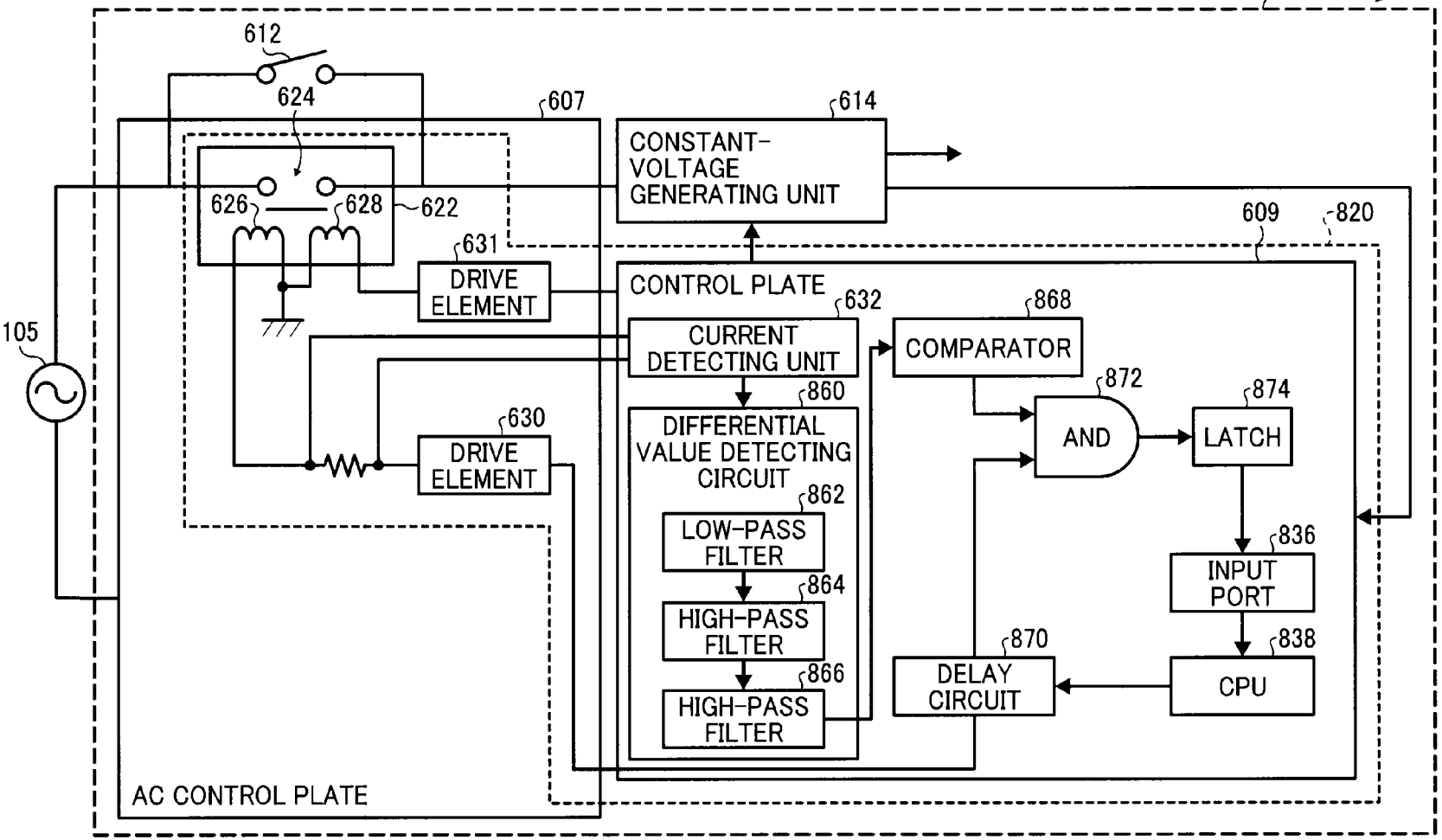
FIG. 21 is a block diagram of an exemplary configuration of a power-supply device according to an eighth embodiment of the present invention.

FIG. 21 is a block diagram of an exemplary configuration of a power-supply device 810 according to the eighth embodiment. An image forming apparatus 800 according to the eighth embodiment includes the power-supply device 810 in which a relay failure detecting device 820 includes a differential value detecting circuit 860, a comparator 868, a delay circuit 870, an AND circuit 872, a latch 874, and an input port 836 that are not present in the sixth embodiment. Moreover, the relay failure detecting device 820 includes a CPU 838 that is different than the CPU 638 according to the sixth embodiment.

The differential value detecting circuit 860 includes a low-pass filter 862 and two high-pass filters 864 and 866 so as to eliminate the chattering noise from a current value, which has been input from the current detecting unit 632, and before outputting the current value. Meanwhile, the differentiated waveforms output by the differential value detecting circuit 860 are identical to the differentiated waveform illustrated in FIGS. 14 and 15.

Thus, if the pulses are detected from the differentiated waveform output by the differential value detecting circuit 860, the shutdown relay 622 can be determined to be functioning normally. On the other hand, if no pulses are detected from the differentiated waveform output by the differential value detecting circuit 860, a failure can be determined to have occurred in the shutdown relay 622. Herein, if the set coil 626 is driven when the contact of the shutdown relay 622 is in the closed state, the differentiated waveform is identical to that illustrated in FIG. 15. However, in that case, after the contact state is determined, it is possible to change the decision regarding normal functioning/failure.

The comparator 868 performs comparator output of the pulse output by the differential value detecting circuit 860. The delay circuit 870 delays, by a few milliseconds, the relay-ON signal transmitted by the CPU 838. The AND circuit 872 obtains a logical product of the comparator output from the comparator 868 and the relay-ON signal delayed by the delay circuit 870. The latch 874 latches the output from the AND circuit 872 and inputs the same to the input port 836.

In this way, since the delay circuit 870 delays the relay-ON signal and the AND circuit 872 obtains a logical product of the comparator output and the relay-ON signal, the pulse generated in onset of the relay-ON state is not input to the input port 836.

The CPU 838 detects a failure in the relay depending on whether the pulse has been input to the input port 836.

Figure 22:
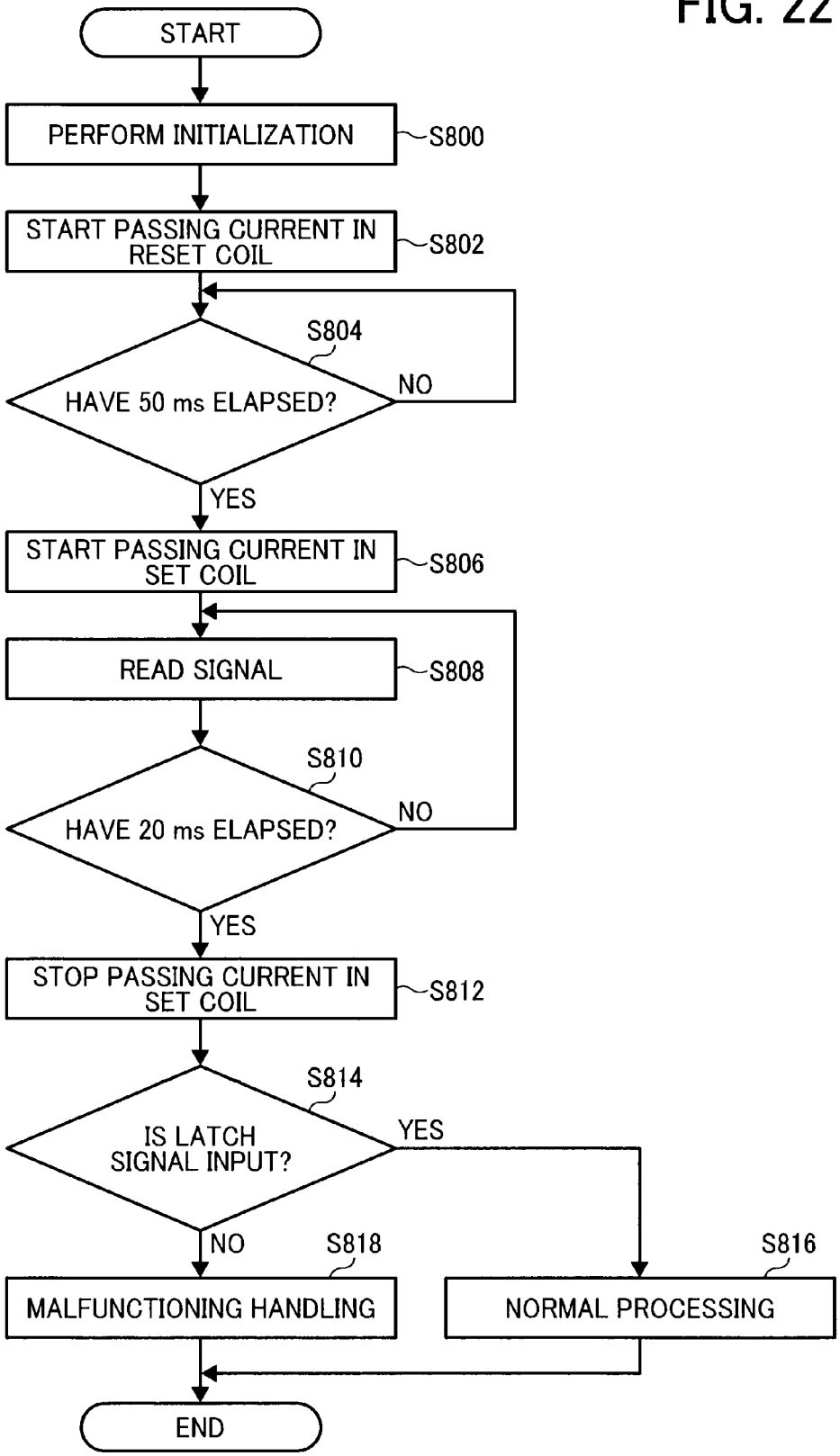
FIG. 22 is a flowchart for explaining an example of the operations performed by an image forming apparatus according to the eighth embodiment.

FIG. 22 is a flowchart for explaining an example of the operations performed by the image forming apparatus 800 according to the eighth embodiment.

Herein, the operations performed from Step S800 to Step S806 are identical to the operations performed from Step S600 to Step S606 as illustrated in the flowchart in FIG. 18. Hence, the explanation of those operations is not repeated.

Upon transmission of the relay-ON signal, the CPU 838 monitors the input to the input port 836 for a predetermined period of time such as 20 ms (No at Step S808 and Step S810).

Upon finishing the monitoring of the input to the input port 836 (Yes at Step S810), the CPU 838 stops driving the drive element 630 so as to stop passing a current to the set coil 626 (Step S812).

The subsequent operations performed from Step S814 to Step S818 are identical to the operations performed from Step S504 to Step S508 as illustrated in the flowchart in FIG. 16. Hence, the explanation of those operations is not repeated.

Thus, according to the eighth embodiment too, it is possible to achieve the same effect as achieved according to the sixth embodiment.

Meanwhile, a relay failure detecting program, which is executed by the control unit of the relay failure detecting device described in the first to fourth embodiments and in the sixth and seventh embodiments, is stored in a read only memory (ROM) in advance.

Alternatively, the relay failure detecting program, which is executed by the control unit of the relay failure detecting device described in the first to fourth embodiments and in the sixth and seventh embodiments, can be provided in the form of an installable or executable file on a computer-readable storage device such as a compact disk read only memory (CD-ROM), a flexible disk (FD), a compact disk recordable (CD-R), or a digital versatile disk (DVD).

Still alternatively, the relay failure detecting program, which is executed by the control unit of the relay failure detecting device described in the first to fourth embodiments and in the sixth and seventh embodiments, can be stored in a computer connected over a network such as the Internet and can be downloaded via the network for distribution. Moreover, the relay failure detecting program, which is executed by the control unit of the relay failure detecting device described in the first to fourth embodiments and in the sixth and seventh embodiments, can be made available for distribution through a network such as the Internet.

Herein, the relay failure detecting program, which is executed by the control unit of the relay failure detecting device described in the first to fourth embodiments and in the sixth and seventh embodiments, contains modules for implementing the functions of the abovementioned control unit in a computer. Regarding the actual hardware, a CPU retrieves the relay failure detecting program from the ROM and runs it such that the relay failure detecting program is loaded in a random access memory (RAM). As a result, the functions of the abovementioned control unit are implemented in the RAM.

Modification Example

Figure 23:
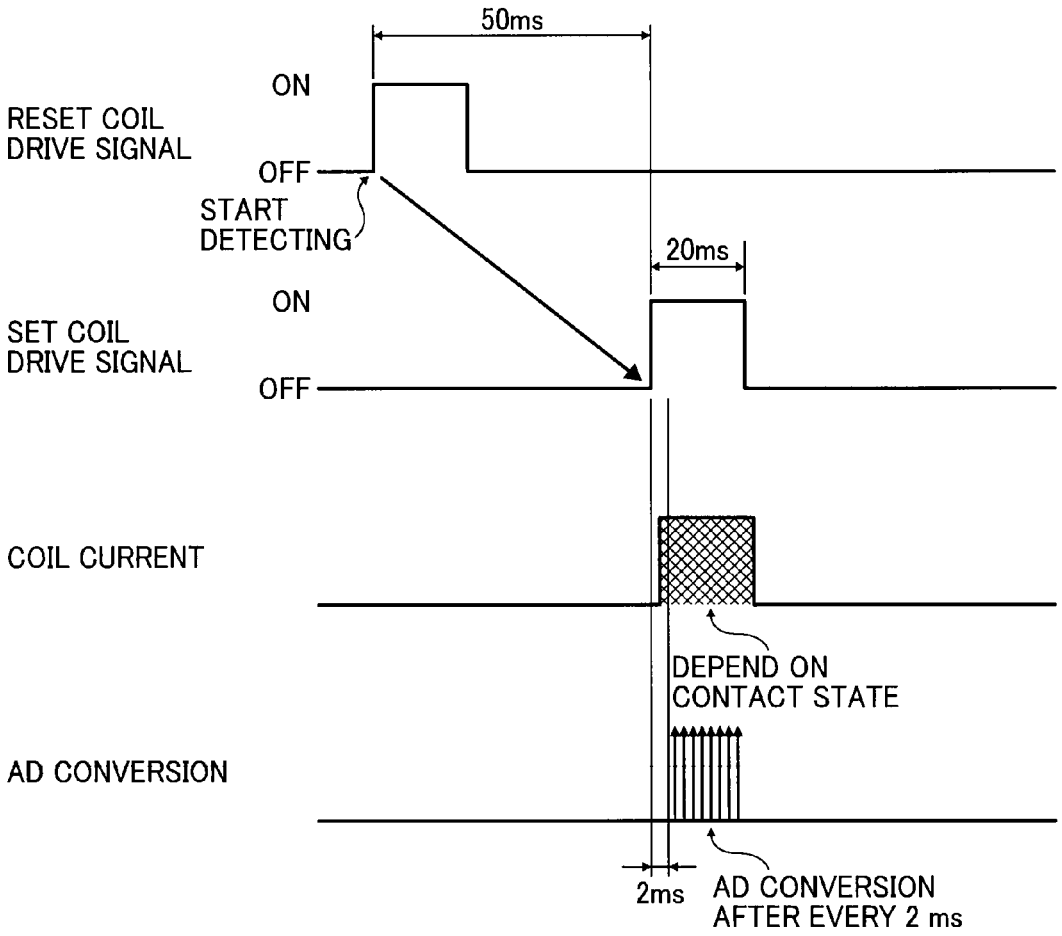
FIG. 23 is an illustrative diagram for explaining a failure detecting method according to a modification example.

The present invention is not limited to the abovementioned embodiments and can be modified in various ways. For example, in the failure detecting method described in the sixth to eighth embodiments, the current flowing in the coil of a relay can be detected with the use of pulse signals over a certain period of time. An example of that is illustrated in FIG. 23. In that case, firstly, the reset coil is driven and the contact is once closed. Then, after the elapse of a certain period of time, the set coil is driven and any change in the current at that time is detected. Therein, irrespective of the contact state, a failure can be detected with the use of the pulse. Meanwhile, it is also possible to suitably combine the abovementioned embodiments.

Thus, according to an aspect of the present invention, it becomes possible to detect a failure in a relay without having to waste any electrical power.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A relay failure detecting device comprising:

an opening-closing unit that is driven by a coil for opening and closing a current pathway;

a detecting unit that detects a current value of a current flowing in the coil;

an opening-closing instructing unit that outputs an instruction signal to instruct opening and closing of the opening-closing unit;

a failure detecting unit that detects a failure in the opening-closing unit by using the current value output by the detecting unit within a predetermined period of time starting from when the instruction signal is output; and a differentiating unit that receives input of the current values, which have been detected by the detecting unit, for the predetermined period of time and outputs a differentiated waveform obtained by differentiating the current values received in the predetermined period of time, the differentiating unit including a high-pass filter and a low-pass filter, wherein when a pulse based on the differentiated waveform is detected, the failure detecting unit detects a failure in the opening-closing unit, and the failure detecting unit detects a failure in the opening-closing unit by comparing a differential value, calculated by differentiating each obtained current value, with a corresponding differential value calculated in the past.

2. The relay failure detecting device according to claim 1, wherein the opening-closing unit is arranged in parallel with a main switch.

3. The relay failure detecting device according to claim 1, wherein upon detecting a failure in the opening-closing unit, the failure detecting unit performs failure handling.

4. The relay failure detecting device according to claim 1, wherein the opening-closing unit is a switch element.

5. The relay failure detecting device according to claim 1, wherein the opening-closing unit is driven by a set coil and a reset coil.

6. A power-supply device comprising the relay failure detecting device according to claim 1.

7. An image forming apparatus comprising the power-supply device according to claim 6.

8. A relay failure detecting method comprising:

outputting an instruction signal to instruct opening and closing of an opening-closing unit;

controlling, by the opening-closing unit, opening and closing a current pathway when a coil is driven;

detecting a current value of a current flowing in the coil;

detecting, a failure in the opening-closing unit by using the current value which has been detected within a predetermined period of time starting from when the instruction signal is output; and outputting a differentiated waveform obtained by differentiating the current values which have been detected during the predetermined period of time, the outputting the differentiated waveform is performed using a high-pass filter and a low-pass filter, wherein when a pulse based on the differentiated waveform is detected, the detecting of a failure detects a failure in the opening-closing unit, and the detecting the failure includes detecting a failure in the opening-closing unit by comparing a differential value, calculated by differentiating each obtained current value, with a corresponding differential value calculated in the past.

9. A computer program product comprising a non-transitory computer-medium containing instructions that, when executed by a computer, cause the computer to perform a relay failure detecting method for a relay failure detecting device, the relay failure detecting device including:

an opening-closing unit that is driven by a coil for opening and closing a current pathway;

a detecting unit that detects a current value of a current flowing in the coil; and an opening-closing instructing unit that outputs an instruction signal to instruct opening and closing of the opening-closing unit, the relay failure detecting method comprising:

outputting an instruction signal to instruct opening and closing of an opening-closing unit;

controlling, by the opening-closing unit, opening and closing a current pathway when a coil is driven;

detecting a current value of a current flowing in the coil;

detecting a failure in the opening-closing unit by the current value which has been detected within a predetermined period of time starting from when the instruction signal is output; and outputting a differentiated waveform obtained by differentiating the current values which have been detected during the predetermined period of time, the outputting the differentiated waveform is performed using a high-pass filter and a low-pass filter, wherein when a pulse based on the differentiated waveform is detected, the detecting of a failure detects a failure in the opening-closing unit, and the detecting the failure includes detecting a failure in the opening-closing unit by comparing a differential value, calculated by differentiating each obtained current value, with a corresponding differential value calculated in the past.

* * * * *